US007387378B2

(12) United States Patent
Kimura et al.

(10) Patent No.: US 7,387,378 B2
(45) Date of Patent: Jun. 17, 2008

(54) LIQUID CONTAINER, COMPONENT FOR FORMING LIQUID CONTAINER, AND METHOD FOR PRODUCING LIQUID CONTAINER

(75) Inventors: Hitotoshi Kimura, Nagano (JP); Taku Ishizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 152 days.

(21) Appl. No.: 10/794,616

(22) Filed: Mar. 5, 2004

(65) Prior Publication Data

US 2004/0217127 A1 Nov. 4, 2004

(30) Foreign Application Priority Data

Mar. 5, 2003 (JP) ..... P2003-059019
Apr. 8, 2003 (JP) ..... P2003-104134

(51) Int. Cl.
*B41J 2/175* (2006.01)

(52) U.S. Cl. ..... 347/86; 347/85

(58) Field of Classification Search ..... 347/85, 347/86, 87; 141/2, 18; 222/380, 391, 394
See application file for complete search history.

(56) References Cited

U.S. PATENT DOCUMENTS 4,514,742 A * 4/1985 Suga et al. ..... 347/85
4,882,596 A * 11/1989 Tsuzuki et al. ..... 347/10
6,000,788 A * 12/1999 Iida ..... 347/86
6,170,939 B1 * 1/2001 Ujita et al. ..... 347/86
6,276,788 B1 * 8/2001 Hilton ..... 347/86

(Continued)

FOREIGN PATENT DOCUMENTS

EP 0 498 117 A2 8/1992

(Continued)

OTHER PUBLICATIONS

Japanese Office Action in JP 2003-059019, dated Sep. 13, 2005 (with complete English translation).

(Continued)

*Primary Examiner*—Anh T. N. Vo
(74) *Attorney, Agent, or Firm*—Stroock & Stroock & Lavan LLP

(57) ABSTRACT

The present invention provides a liquid container which has a check valve for preventing a flow of outside air into its inside and which is capable of maintaining the performance of the check valve constant. An ink pack (25) includes a bag portion (36), which holds an outlet portion by heat-welding. An internal space (S) is formed in the bag portion (36), and ink is contained therein. The outlet portion has a first flow path forming component (41). A first recess portion (47) is recessed from the one side surface (41*a*) of the first flow path forming component (41). First and second ink flow paths (46, 51), which communicate with the internal space (S), extend from a bottom surface (47*a*) of this first recess portion (47). A valve seat (53) is formed in a projecting shape so as to surround the second ink flow path (51). A laminate film (36*a*) sealingly closes the first recess portion (47). Thus, a valve body accommodating chamber (55) is formed. The valve body accommodating chamber (55) accommodates a first valve body (58). The valve body (58) and the valve seat (53) form a first valve device (59).

13 Claims, 18 Drawing Sheets

U.S. PATENT DOCUMENTS

| | | | | |
|---|---|---|---|---|
| 6,554,412 | B1 * | 4/2003 | Seino et al. | 347/86 |
| 6,612,690 | B1 * | 9/2003 | Wallace et al. | 347/86 |
| 6,719,415 | B1 | 4/2004 | Hattori et al. | |
| 6,874,876 | B2 * | 4/2005 | Ishizawa et al. | 347/86 |
| 7,246,891 | B2 * | 7/2007 | Qingguo et al. | 347/86 |
| 2001/0022603 | A1 | 9/2001 | Eida | |
| 2002/0196312 | A1 | 12/2002 | Ishizawa et al. | |
| 2003/0071874 | A1 | 4/2003 | Ishizawa et al. | |

FOREIGN PATENT DOCUMENTS

| | | | |
|---|---|---|---|
| EP | 0 709 207 | A2 | 5/1996 |
| EP | 0 965 780 | A1 | 12/1999 |
| EP | 1 270 235 | A1 | 1/2003 |
| JP | 60-003852 | A | 1/1985 |
| JP | 01-133749 | A | 5/1989 |
| JP | 04-214360 | A | 8/1992 |
| JP | 05-185603 | A | 7/1993 |
| JP | 08-080616 | A | 3/1996 |
| JP | 10-258889 | A | 9/1998 |
| JP | 11-157093 | A | 6/1999 |
| JP | 2001-063090 | A | 3/2001 |
| JP | 2001-232812 | A | 8/2001 |
| JP | 2002-113881 | A | 4/2002 |
| JP | 2002-192739 | A | 7/2002 |
| JP | 2002-210960 | A | 7/2002 |
| JP | 2002-331684 | A | 11/2002 |

OTHER PUBLICATIONS

Search Report dated Jul. 6, 2004 in European application EP 04 00 5309.

* cited by examiner

LIQUID CONTAINER, COMPONENT FOR FORMING LIQUID CONTAINER, AND METHOD FOR PRODUCING LIQUID CONTAINER

BACKGROUND OF THE INVENTION

The present invention relates to a liquid container, a component for forming a liquid container, and a method for producing a liquid container.

Conventionally, an ink jet recording apparatus has been widely used as a liquid ejecting apparatus, which ejects liquid to a target. In greater detail, this ink jet recording apparatus comprises a carriage, a recording head mounted on the carriage, and an ink cartridge containing ink as liquid. Printing is carried out on a recording medium by ejecting ink from nozzles formed on the recording head while moving the carriage relative to the recording medium and providing ink to the recording head from the ink cartridge.

Moreover, in such an ink jet recording apparatus, in order to reduce the load on a carriage, or to make the apparatus compact and thin, there is a structure, in which an ink cartridge is not mounted on a carriage (a so-called off-carriage type). Such an ink cartridge typically includes an ink pack containing ink, and a case accommodating the ink pack.

Conventionally, an ink pack 180 with an outlet portion 181 shown in FIG. 25 is known as such an ink pack (For example, see Japanese Patent Application Publication No. 2002-192739). In detail, this outlet portion 181 is held in an opening of a bag portion 182 of the ink pack 180 in a manner being sandwiched, and discharges the ink contained in the bag portion 182. This outlet portion 181 is provided with a first tube body 183, and a second tube body 184.

An annular rubber packing 185, and a first valve body 187 capable of sealingly closing an opening of the rubber packing 185 by a biasing force of a coil-shaped spring component 186 are provided inside the first tube body 183. When an ink inlet tube 188 connected to an ink supply tube (not show) is inserted into the outlet portion 181, a first valve body 187 is pressed and moved by the ink inlet tube 188, and then the opening of the rubber packing 185 is opened.

In addition, in the state where the ink inlet tube 188 is not inserted into the outlet portion 181, the first valve body 187 abuts and sealingly closes the opening of the rubber packing 185 so that the ink in the ink pack 180 does not leak to the outside.

The second tube body 184 is fixed by press-fitting into the first tube body 183. A valve body accommodating chamber 191 is defined by the second tube body 184 and the first tube body 183. This valve body accommodating chamber 191 movably accommodates a disc-shaped second valve body 192. This second valve body 192 abuts a valve seat 193 provided in the second tube body 184 so as to sealingly close a tube path of the outlet portion 181. On the other hand, when the pressure of the ink in the ink pack increases, the second valve body 192 moves away from the valve seat 193 so as to open the path of the outlet portion 181. Thus, this second valve body 192 and the seat 193 construct a valve device 194, this valve device 194 functions as a check valve, which allows the flow of ink only from an inside of the ink pack 180 to the outside.

In order to supply ink from the ink pack 180 having the outlet portion 181 as constructed above to a recording head, an ink inlet tube 188 is first inserted into the outlet portion 181, then the pressure of the ink in the ink pack 180 is increased by pressing the bag portion 182 or the like. As a result, the second valve body 192 moves away from the valve seat 193, and the ink in the ink pack 180 is supplied to the recording head through the outlet portion 181 and an ink supply tube.

The ink pack 180 having the outlet portion 181 as mentioned above has the following advantages: That is, for example, even if a user forcedly moves the first valve body 187 with a screw driver, etc., the valve device 194 functions as a check valve. Accordingly, this can prevent leakage of the ink in the ink pack 180 to the outside because the movement of the first valve body 187 by such user's operation causes ink in the interior of the first tube body 183 to attempt to flow into the inside of the ink pack 180 but this relatively strong or quick reverse flow of ink instantaneously move the second valve body 192 to seat on, the valve seat 193. Also, this can prevent the outside air and so on associated with such relatively strong or quick reverse flow from flowing into the ink pack 180, to thereby maintain the degassed rate or cleanliness of the ink in the ink pack 180.

In addition, the valve device 194 functioning as a check valve may permit a slight or slow reverse flow which does not cause the entry of the outside air and so on into the ink pack 180, and which would be occasionally caused, for example, during printing.

The outlet portion 181 is required to maintain high performance of the valve device 194 functioning as a check valve, and therefore to improve airtightness of the valve body accommodating chamber 191. As one of methods for improving airtightness of the valve body accommodating chamber 191, heat-crimping is used to fix the first tube body 183 and the second tube body 184 in a tight fit state to form the valve body accommodating chamber 191.

However, since recent tendency is directed toward a case in which both of the first tube body 183 and second tube body 184 are formed of synthetic resin or the like such as plastic, and since both of the first tube body 183 and the second tube body 184, in this case, are rigid, the aforementioned method suffers from a possibility that unevenness in dimension of the first and second tube bodies 183 and 184, and thus unevenness in airtightness of the valve body accommodating chamber 191 tends to appear. This deteriorates the performance of the second valve body 192 as a check valve.

The present invention aims at solving the above problem, and its object is to provide a liquid container, a component for forming a liquid container, and a method for producing the liquid container capable of maintaining constant performance of a check valve disposed in the liquid container.

Another object of the present invention is to provide a liquid container having a check valve that can more reliably prevents the flow of outside air or the like into its inside.

Yet another object of the present invention is to ease injection of ink into a liquid container having a check valve.

SUMMARY OF THE INVENTION

In the present invention, a liquid container comprises a liquid containing portion for containing liquid; a flow path forming component connected to the liquid containing portion; a liquid flow path, which is provided in the flow path forming component, for communicating an inside and an outside of the liquid containing portion; and a check valve, which is provided in the liquid flow path, for limiting flow of liquid between the inside of the liquid containing portion and the outside to only a single direction, wherein the check valve includes a valve seat and a valve body, the valve body is accommodated in the valve body accommodating chamber formed in the liquid flow path, the valve body accommodating chamber is formed of a recess portion for accommodating the valve body formed in a recessed shape in the flow path forming component, and a first flexible component sealingly closing the recess portion for accommodating the valve body.

According to the present invention, the valve body accommodating chamber for accommodating the valve body of the check valve, which is provided in the liquid container, is formed of the recess portion for accommodating the valve body, which is formed in the flowpath forming component, and the first flexible component, which sealingly closes it. In the case where the valve body accommodating chamber is formed by crimping rigid bodies together, for example, dimensional deviation occurring in forming the valve body accommodating chamber may deteriorate the airtightness of the valve body accommodating chamber. On the contrary, according to the present invention, since the valve body accommodating chamber is formed of a first flexible component having flexibility, the junction is improved. As a result, the airtightness of the valve body accommodating chamber is improved, and the performance of the check valve is maintained constant.

In this liquid container, the check valve allows the flow of liquid from the inside of the liquid containing portion to the outside and stops the flow of liquid from the outside to the inside of the liquid containing portion, the valve body is located at a position close to the outside from the valve seat, the recess portion for accommodating the valve body communicates with the inside of the liquid containing portion for containing liquid in the state where the recess portion for accommodating the valve body is not sealingly closed by the first flexible component, and does not communicate with the inside of the liquid containing portion in the state where the recess portion for accommodating the valve body is sealingly closed by the first flexible component.

According to this construction, in production of a liquid container, since the recess portion for accommodating the valve body is in the state not being sealingly closed by the first flexible component, this can allow for liquid to be injected into the inside of the liquid containing portion through the recess portion for accommodating the valve body. Subsequently, after the injection of the liquid is completed, forming the recess portion for accommodating the valve body by sealingly closing by the first flexible component can allow for the check valve to have a function of allowing the flow of liquid only from the inside of the liquid containing portion to the outside.

Accordingly, even if a liquid container has a check valve for stopping the flow of liquid from the outside to the inside of the liquid containing portion in the liquid flow path, it is possible to inject liquid from the liquid flow path to the inside of the liquid containing portion through a recess portion for accommodating a valve body. As a result, after only the inside of the liquid containing portion is decompressed through the liquid flow path, liquid is injected through the liquid flow path and the recess portion for accommodating the valve body again, so that it is possible to inject liquid of high purity into the liquid containing portion. Therefore, it is not necessary to provide a large-scale decompressor to decompress the whole periphery of a liquid container, so that it is possible to produce a liquid container at low cost.

In this liquid container, the first flexible component sealingly closes the recess portion for accommodating the valve body by being heat-welded on the flow path forming component.

This construction ensures that the valve body accommodating chamber is sealingly closed, and improves the accuracy of airtightness of the valve body accommodating chamber to maintain the constant performance of a check valve.

In this liquid container, the first flexible member is integrally formed with the liquid containing portion.

According to this construction, the first flexible component and the liquid containing portion are integrally formed, and the number of components can be reduced, therefore, it is possible to reduce the manufacturing cost of a valve body accommodating body.

In this liquid container, the liquid containing portion includes a component for forming the liquid containing portion which is integrally formed with the flow path forming component, and a second flexible component for sealingly closing a recess portion for containing liquid formed in the component for forming the liquid containing portion. Further, the first flexible component and the second flexible component are integrally formed to form a third flexible component.

According to this construction, since the first flexible component and the second flexible component are integrally formed, it is possible to perform both sealing of the recess portion for containing liquid by the second flexible component to form the liquid containing portion and sealing of the recess portion for accommodating the valve body by the first flexible component That is, both of the sealings can be performed simultaneously and/or with the use of the same component. Accordingly, this can save effort in producing a valve body accommodating body, and can reduce manufacturing cost.

In this liquid container, the valve body includes means for regulating the amount of movement in the direction away from the valve seat.

According to this construction, the check valve stably opens and closes, so that the performance of the check valve can be made preferable.

In this liquid container, the valve body is formed of an elastic material.

According to this construction, it is possible to biase the valve body in the direction that the valve body abuts against or moves away from the valve seat by using the elastic force of the valve body itself. As a result, control of opening and closing of the check valve is easy, so that the performance of the check valve can be more preferable.

In this liquid container, the valve seat is formed so as to project toward the valve body side.

According to this construction, the valve body and the valve seat are in closer contact with each other, so that the performance of the check valve can be made preferable.

In this liquid container, the recessed direction of the recess portion for accommodating the valve body is perpendicular to the flow direction of the liquid flow path.

According to this construction, the valve body is easily accommodated in the recess portion for accommodating the valve body, so that it is possible to produce a liquid container easily.

In this liquid container, a first liquid flow path, which is a portion between the valve body accommodating chamber and the inside of the liquid containing portion, is provided along the extension of the recessed direction of the recess portion for accommodating the valve body.

According to this construction, the recess portion for accommodating the valve body and a partial flow path, which is a part of the liquid flow path, are located in a straight line. Accordingly, forming a through hole in a flow path forming component can form the recess portion for accommodating the valve body and the partial flow path together, therefore, it is possible to produce a liquid container easily.

In this liquid container, the liquid is ink, and the liquid container is an ink pack used for an ink jet recording apparatus.

According to this construction, the performance of the check valve provided in the ink pack used in the ink jet recording apparatus can be constant. Since the check valve is provided so as to allow the flow of ink only from the ink pack to a recording head of the ink jet apparatus, it is possible to prevent the reverse flow of ink, the flow of air, or the like, into the ink pack. As a result, this improves the degassed, rate and cleanliness of the ink in the ink pack, therefore, it is possible to provide preferable printing in an ink jet recording apparatus.

In this liquid container, the liquid containing portion is a film member, means for preventing deformation of the liquid flow path is provided in a welded portion of the fluid path forming component where the film member is welded.

According to this construction, since means for preventing deformation to prevent deformation of the liquid flow path to a minimum is provided in the flow path forming component, it is possible to prevent deformation of the liquid flow path to a minimum when the film member is welded onto the flow path forming component. Thus, even when the film member is welded onto the flow path forming component, the liquid flow path hardly deforms by welding. Accordingly, it is possible to smoothly discharge liquid to the outside through the liquid flow path. In addition, since the liquid flow path hardly deforms, even if a valve device is provided in a welded portion of the flow path forming component where the film member is welded, this construction can reduce the possibility that a second valve body is stopped in the middle of a liquid flow path, and can ensure the operation of the valve device more reliably. Thus, when the valve device is provided in the welded portion where the film member is welded, shortening the length of the liquid flow path can downsize the whole of a liquid container.

In this liquid container, the means for preventing deformation is a rib inwardly projecting in the liquid flow path located in the welded portion.

According to this construction, means for preventing deformation is a rib inwardly projecting in the liquid flow path. Although it is conceivable to make a periphery portion of the liquid flow path thick in order to prevent deformation of the liquid flow path, in this case, a sink (a recess formed on the surface) occasionally appears in the periphery of the flow path forming component. That is, for this recess, it is difficult for the film member to be in intimate contact with the flow path forming component. However, providing the rib in the liquid flow path as mentioned above can allow for the thickness of the periphery of the flow path forming component to be thick partially. Thus, the liquid flow path hardly deforms as increasing the thickness of the welded portion, however, a portion with increased thickness is limited to only a part of it. Accordingly, it is possible to prevent the appearance of a sink to a minimum. Therefore, it is possible to keep deformation of the liquid flow path to a minimum, and to allow for the flow path forming component and the film member to be in intimate contact with each other easily by keeping the appearance of a sink to a minimum.

In this liquid container, the means for preventing deformation is a groove formed in an annular or arcuate shape around the periphery of the liquid flow path in the welded portion.

According to this construction, means for preventing deformation is the groove formed in an annular or arcuate shape around the periphery of the liquid flow path. Thus, since the heat during heat-welding first deforms a groove portion and then deforms a middle circular portion, the middle circular portion is more difficult to deform. In addition, the distance between the periphery portion of the welded portion, where the heat in heat-welding is applied, and the middle circular portion can be greater, and the thickness between the middle circular potion and the groove portion can be thinner. Accordingly, the middle circular portion hardly deforms, and a sink hardly appears. Therefore, it is possible to keep deformation of the liquid flow path to a minimum, and to allow for the flow path forming component and the film member to be in intimate contact with each other easily by keeping the appearance of a sink to a minimum.

In this liquid container, a part of the component of a valve mechanism, which opens and closes this liquid flow path is provided in the liquid flow path located in the welded portion where the means for preventing deformation is provided.

According to this construction, a part of the component of the valve mechanism, which opens and closes this liquid flow path, is provided in the liquid flow path located in the welded portion. Accordingly, since the valve mechanism, which opens and closes the liquid flow path, can be disposed without escaping the liquid flow path of the welded portion, the length of the liquid flow path can be shortened to downsize the whole of a liquid container.

In this liquid container, the valve mechanism includes a second valve seat; a second valve body, which is seated on this second valve seat so as to be in a valve close state and moves away from the second valve seat so as to be in a valve open state; and means for biasing the second valve seat so that this second valve body is normally seated on the second valve seat, wherein means for regulating the movement of the second valve body so that the second valve body is not located in the liquid flow path located in the welded portion is provided in the liquid flow path.

According to this construction, means for regulating the second valve body is provided so that the second valve body, which performs the operation for opening and closing of the valve mechanism, is not located in the liquid flow path of the welded portion. That is, the second valve body is not located in the liquid flow path of the welded portion. Accordingly, even if the liquid flow path of the welded portion deforms regardless of providing means for preventing deformation, the second valve body, which performs the operation for opening and closing of the valve mechanism, does not come into the deformed liquid flow path of the welded portion. Therefore, this construction can further reduce the possibility that the second valve body does not operate by entering into the deformed liquid flow path, and can ensure the operation for opening and closing of the valve mechanism more reliably.

In this liquid container, guiding means is provided in the liquid flow path so that the second valve body moves along the inner wall of the flow path forming component as a guide.

According to this construction, the second valve body moves along the inner wall of the flow path forming component, while being guided thereby. Thus, when the inner wall deforms by deformation of the liquid flow path, the second valve body moves along the deformed guiding means. However, since means for preventing deformation is provided so as to prevent deformation of the liquid flow path, the second valve body is seldom guided by such a deformed guiding means. Therefore, it is possible to ensure that the second valve body moves more reliably, and to ensure the operation for opening and closing of the valve mechanism more reliably.

In the present invention, a component for forming a liquid container comprises a liquid containing portion capable of containing liquid, a flow path forming component connected to the liquid containing portion, a liquid flowpath, which is provided in the flow path forming component, for communicating an inside and an outside of the liquid containing portion, and a check valve, which is provided in the liquid flow path, for allowing only the flow of liquid from the inside of the liquid containing portion to the outside, a recess portion for accommodating a valve body formed in the liquid flow path forming component so as to communicate with the liquid flow path and the liquid containing portion, a first flexible component, which is provided so as to be capable of sealingly closing the recess portion for accommodating the valve body, wherein when the recess portion for accommodating the valve body is sealingly closed by the first flexible component, the recess portion for accommodating the valve body does not communicate with the inside of the liquid containing portion. The check valve includes a valve seat and the valve body, which is located at the position close to the outside from the valve seat, the valve body is located inside the recess portion for accommodating the valve body.

According to the present invention, when liquid is injected into the liquid containing portion of the liquid container forming component, it is possible to inject liquid into the inside of the liquid container through the recess portion for accommodating the valve body. Subsequently, after the injection of the liquid is completed, sealingly closing the recess portion for accommodating the valve body by the first flexible component can allow for the check valve to have a function of allowing the flow of liquid only from the inside of the liquid containing portion to the outside.

Accordingly, even if the liquid container comprises the check valve for stopping the flow of liquid from the outside to the inside of the liquid containing portion in the liquid flow path, it is possible to inject liquid from the liquid flow path to the inside of the liquid containing portion through the recess portion for accommodating the valve body. As a result, after only the inside of the liquid containing portion is decompressed through the liquid flow path, liquid is injected through the liquid flow path and the recess portion for accommodating the valve body again, so that it is possible to inject liquid of high purity into the liquid containing portion. Therefore, it is not necessary to provide a large-scale decompressor to decompress the whole periphery of the liquid container, so that it is possible to produce the liquid container at low cost.

In the present invention, there is provided a method for producing a liquid container including a liquid containing portion capable of containing liquid, a flow path forming component connected to the liquid containing portion, a liquid flow path, which is provided in the flow path forming component, for communicating an inside and an outside of the liquid containing portion, and a check valve, which is provided in the liquid flow path, for allowing flow of liquid only from the inside of the liquid containing portion to the outside. The method comprises steps of: injecting the liquid into the inside of the liquid containing portion through a recess portion, which is formed in the liquid flow path forming component at a position close to the outside from a valve seat of the check valve, which allows the liquid flow path to communicate with the inside of the liquid container, and which accommodates a valve body of the check valve; and sealingly closing the recess portion for accommodating the valve body by a first flexible component so that the recess portion for accommodating the valve body is in a non-communicating state with the inside of the liquid containing portion.

Thus, according to the present invention, since liquid is injected into the inside of the liquid containing portion of the liquid container through the recess portion for accommodating the valve body, injection of liquid to the liquid container is not hindered by the check valve. Further, since the recess portion for accommodating the valve body is sealingly closed by the first flexible component after the injection of the liquid, the liquid container, i.e. a completed product, has the check valve having a function of allowing the flow of liquid only from the inside of the liquid containing portion to the outside.

Namely, even if the liquid container comprises the check valve, provided in the liquid flow path, for stopping the flow of liquid from the outside to the inside of the liquid containing portion, it is possible to inject liquid from the liquid flow path to the inside of the liquid containing portion through the recess portion for accommodating the valve body. As a result, after only the inside of the liquid containing portion is decompressed through the liquid flow path, liquid is injected through the liquid flow path and the recess portion for accommodating the valve body again, so that it is possible to inject liquid of high purity into the liquid containing portion. Therefore, it is not necessary to provide a large-scale decompressor to decompress the whole periphery of the liquid container, so that it is possible to produce a liquid container at low cost.

In the present invention, there is provided a method for producing a liquid container comprising a liquid containing portion capable of containing liquid, a flow path forming component connected to the liquid containing portion, a liquid flow path, which is provided in the flow path forming component, for communicating an inside and an outside of the liquid containing portion, and a check valve, which is provided in the liquid flow path, for allowing only flow of liquid from the inside of the liquid containing portion to the outside, the liquid containing portion including a component for forming the liquid containing portion, which is integral with the flow path forming component, and also including a recess portion for containing the liquid, which is formed in the component for forming the liquid containing portion. The method comprises steps of sealingly closing both a recess portion for accommodating a valve body of the check valve, which recess is formed in the flow path forming component, communicates with the liquid flow path and accommodates the valve body of the check valve, and the recess portion for containing the liquid by a third flexible component; and injecting the liquid into a space formed by the recess portion for containing the liquid and the third flexible component.

Thus, according to the present invention, in the sealingly closing step, it is possible to simultaneously perform both sealing the recess portion for containing the liquid by the third flexible component to form the liquid containing portion and sealing the recess portion for accommodating the valve body by the third flexible component. Accordingly, this can save effort in producing a valve body accommodating body, and can reduce manufacturing cost.

The present disclosure relates to the subject matter contained in Japanese patent application Nos. 2003-059019

(filed on Mar. 5, 2003) and 2003-104134 (filed on Apr. 8, 2003), each of which is expressly incorporated herein by reference in its entirety.

DESCRIPTION OF THE PREFERRED EMBODIMENT

Embodiment 1

The following description will describe one embodiment to give a concrete form to the invention with reference to FIG. 1 to FIG. 11.

Figure 1:
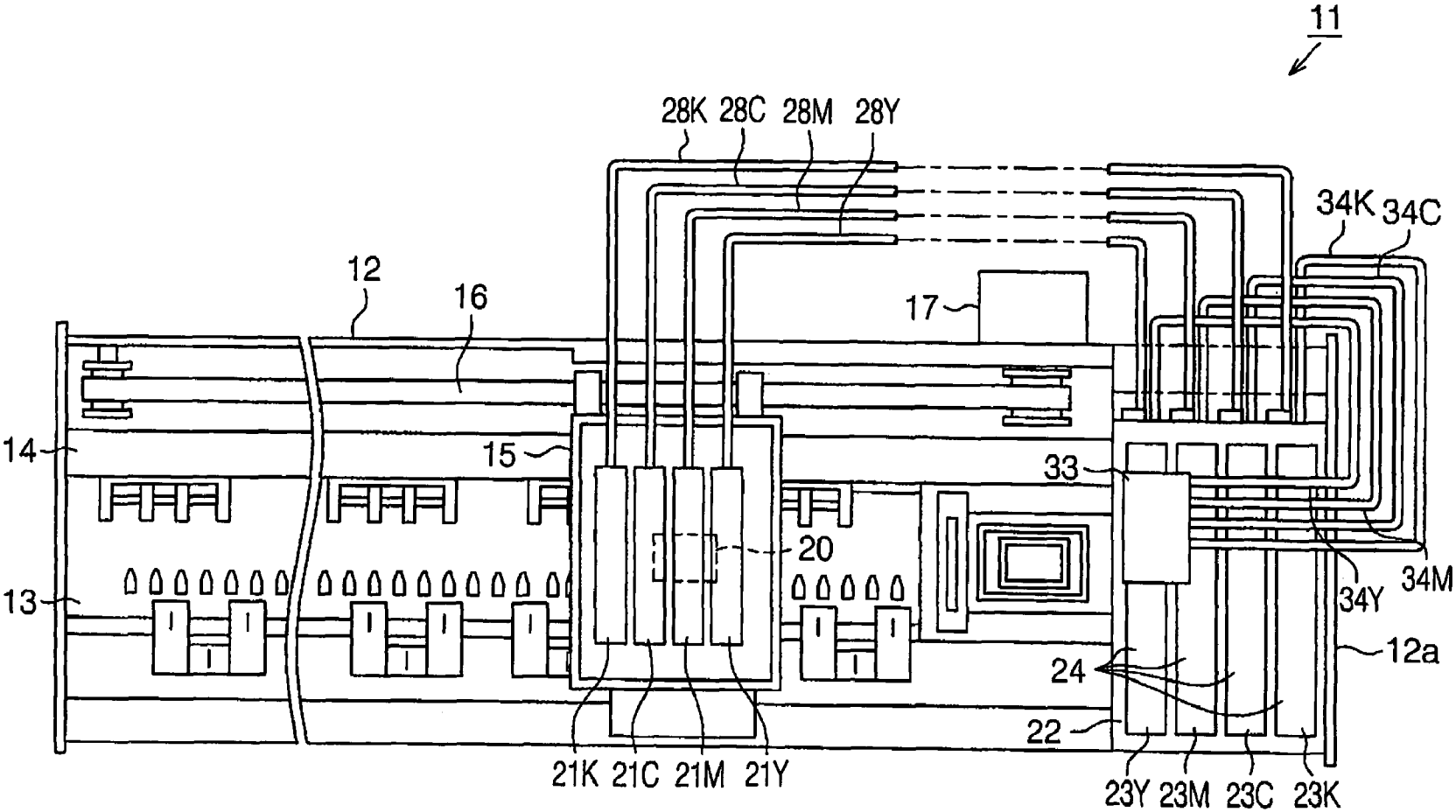
FIG. 1 is a plan view of a printer according to Embodiment 1.

As shown in FIG. 1, a printer 11 as an ink jet recording apparatus according to the present invention comprises a nearly rectangular parallelepiped frame 12 with an opening on its upper side. A paper-feeding component 13 is constructed on the frame 12 so that a paper can be fed on this paper-feeding component 13 by a paper-feeding mechanism (not shown). A guide component 14 is constructed on the frame 12 in parallel to the paper-feeding component 13. In this guide component, the carriage 15 is inserted and supported movably in the axis direction of the guide component 14. In addition, this carriage 15 is connected to a carriage motor 17 via a timing belt 16. The carriage motor 17 drives the carriage 15 so as to move along the guide component 14 back and forth.

A recording head 20 is mounted on the surface of the carriage 15 opposing the paper-feeding component 13. Valve units 21K, 21C, 21M, and 21Y (hereinafter occasionally referred to as simply "valve unit 21" as representative of respective valve units) for supplying ink as liquid to the recording head 20 are mounted on the carriage 15. In this embodiment, four valve units 21K, 21C, 21M, and 21Y are provided corresponding to ink colors (respective colors, black ink K, cyan C, magenta M, and yellow Y) in order to temporarily store the ink therein.

In addition, nozzle outlets (not shown) are provided on the under surface of the recording head 20. Ink is supplied from the valve units 21K, 21C, 21M, and 21Y to the recording head 20, and then ink droplets are ejected onto a paper by drive of piezoelectric elements (not shown) to print.

A cartridge holder 22 is formed at the right end of the frame 12. Ink cartridges 23K, 23C, 23M, and 23Y (hereinafter occasionally referred to as simply "ink cartridge 23" as representative of respective ink cartridges) are removably provided on the cartridge holder 22. Each of these ink cartridges 23K, 23C, 23M, and 23Y includes an outer case 24 which can define at least a part of a hermetically sealed interior, and an ink pack 25 (see FIG. 2) that is provided inside the outer case 24 and that functions as a liquid container. The ink packs 25 contain the black ink K, and respective color ink, cyan C, magenta M and yellow Y, and a detailed description will be described later.

The ink packs 25 of the ink cartridges 23 and the valve units 21 are connected to each other through flexible supply tubes 28K, 28C, 28M, and 28Y (hereinafter occasionally referred to as simply "supply tube 28" as representative of respective supply tubes), respectively.

In addition, a pressure pump 33 is provided above the ink cartridge 23Y containing yellow ink Y. This pressure pump 33 is connected to the outer cases 24 of the ink cartridges 23K, 23C, 23M, and 23Y through air supply tubes 34K, 34C, 34M, and 34Y, respectively. Accordingly, air pressurized by the pressure pump 33 is supplied to the outer cases 24 of the ink cartridges 23K, 23C, 23M, and 23Y through the air supply tubes 34K, 34C, 34M, and 34Y so that the pressurized air is introduced into spaces (not shown) formed between the outer cases 24 and the ink packs 25.

That is, air is supplied into the outer case 24 by drive of the pressure pump 33, therefore, the ink pack 25 is pressed by the pressurized air. Consequently, the respective ink contained in the ink packs 25 is supplied to the valve units 21K, 21C, 21M, and 21Y through the supply tubes 28K, 28C, 28M, 28Y.

Next, the following description will describe the ink pack 25 in greater detail with reference to FIG. 2 to FIG. 9.

Figure 2:
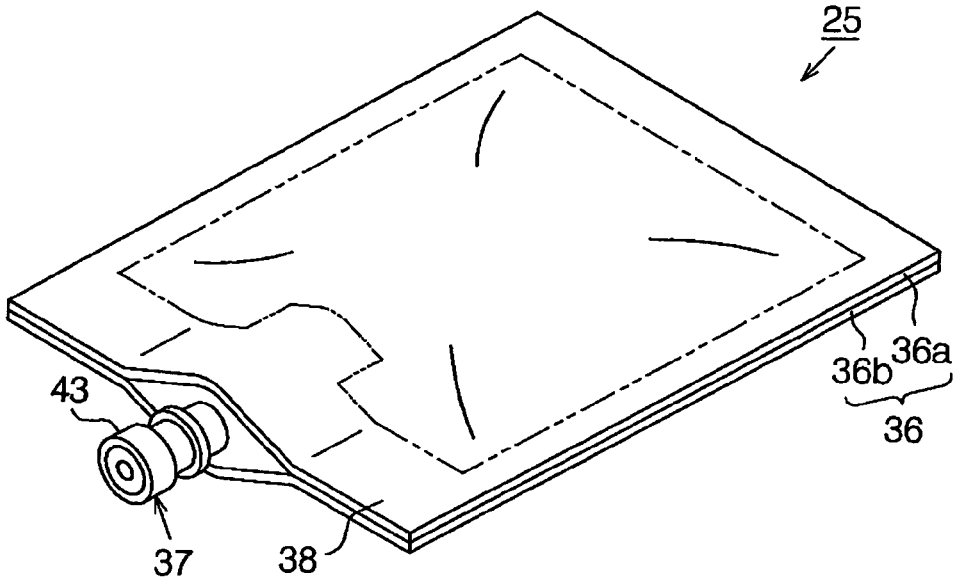
FIG. 2 is a perspective view of the ink pack according to Embodiment 1.

As shown in FIG. 2, the ink pack 25 according to this embodiment comprises a bag portion 36 as a liquid containing portion and an outlet portion 37. In this embodiment, the bag portion 36 comprises two laminate films 36*a* and 36*b* that have the same size and a rectangular shape and that serve as a first flexible component. These laminate films 36*a* and 36*b* are overlaid one on the other, and then heat-welded at four sides to form a bag shape. The outlet portion 37 is heat-welded to a side 38, which is one of the four sides of the bag portion 36, in a state in which the outlet portion 37 is held between the laminate films 36*a* and 36*b*. Thus, the internal space S (see FIG. 5) of the bag portion 36 is sealed, and contains ink. In addition, each of the, laminate films 36*a* and 36*b* are formed of a polyethylene film having gas-barrier characteristics onto which aluminum is vapor-deposited.

Figure 3:
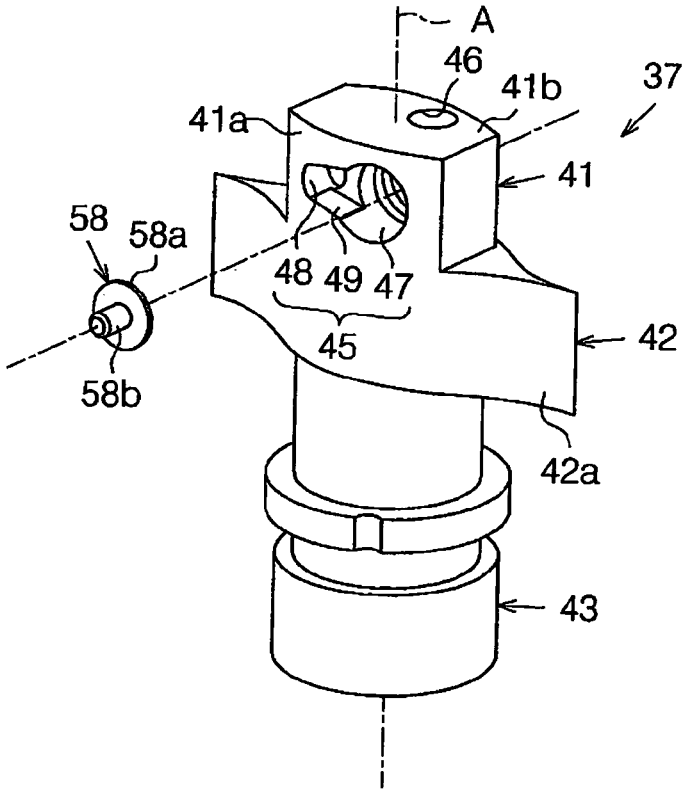
FIG. 3 is an exploded perspective view of a primary part of an outlet portion according to Embodiment 1.

The outlet portion 37 is designed to allow the ink contained in the internal space S of the bag portion 36 to flow out therefrom, and comprises a first flow path forming component 41, a second flow path forming component 42, and a third flow path forming component 43 arranged in this order along the axis line A as shown in FIG. 3. These flow path forming components 41-43 are integrally formed of a synthetic resin, such as plastic, or the like.

In this embodiment, the first flow path forming component 41 has a shape such as a boat shape, which has both edges cut straightly, in a cross-sectional view perpendicular to the axis line A. That is, the first flow path forming component 41 has two opposing convex surfaces (side surfaces 41*a*, 41*c*, see FIGS. 2 and 5) and two opposing planar surfaces that are in parallel to each other and that connect the convex surfaces, to thereby provide the boat shape in the cross-sectional view. The first flow path forming component 41 has a large recess portion 45 which is recessed from one side surface 41*a* (the convex surface) in a direction perpendicular to the axis line A. The first flow path forming component 41 has a first ink flow path 46 which is in a recessed shape and which extends from an upper surface 41*b* in a direction parallel to the axis line A.

Figure 4:
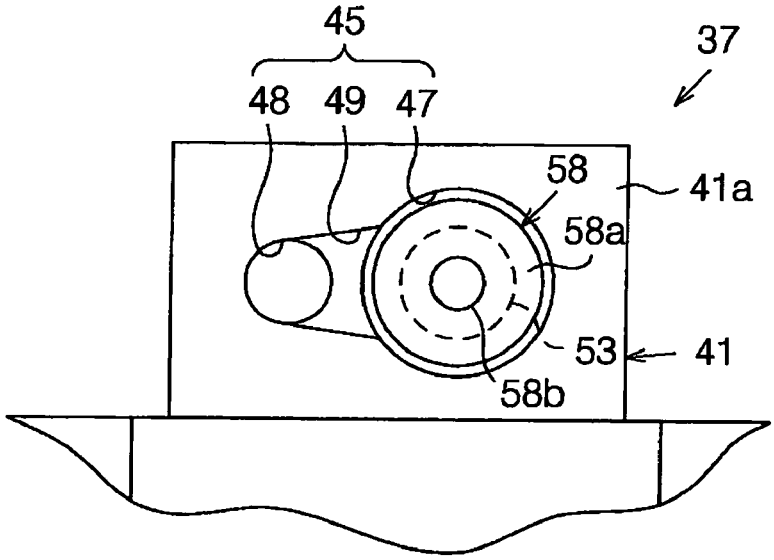
FIG. 4 is a plan view of a primary part of an outlet portion according to Embodiment 1.
Figure 5:
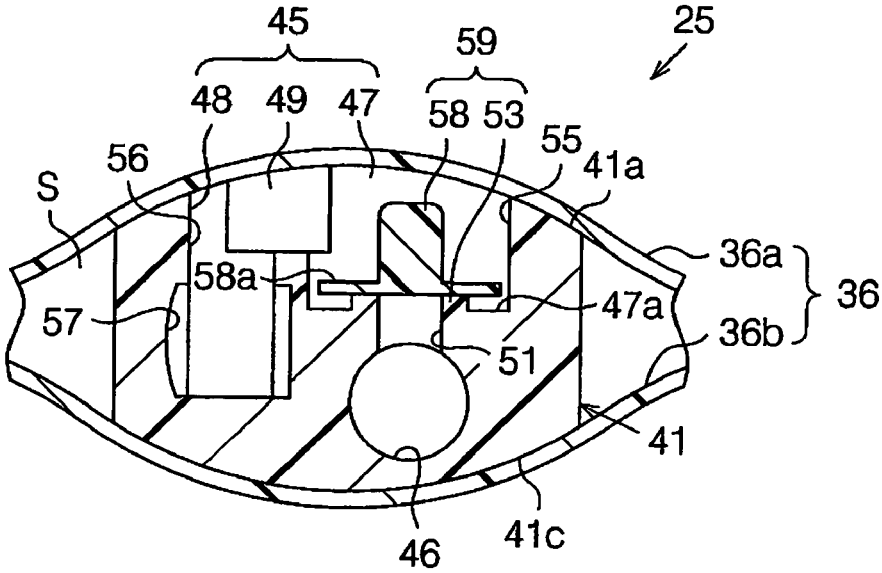
FIG. 5 is a fragmentary sectional view of the ink pack according to Embodiment 1.

As shown in FIG. 3 to FIG. 5, the large recess portion 45 comprises a first recess portion 47, which is circular in cross-section and which serves as a recess portion for accommodating a valve body, a second recess portion 48 which is circular in cross-section and which has a diameter smaller than that of the first recess portion 47, and a third recess portion 49, which communicates with the first recess portion 47 and the second recess portion 48. As shown in FIG. 5, a second ink flow path 51 having a diameter smaller than that of the first recess portion 47 is formed to extend from the bottom surface 47*a* of the first recess portion 47 in the direction perpendicular to the axis line A (see FIG. 3). This second ink flow path 51 communicates with the first ink flow path 46. Additionally, an annular valve seat 53 is formed in a projecting shape in the bottom surface 47*a* of the first recess portion 47 so as to surround the outlet of the second ink flow path 51.

Figure 6:
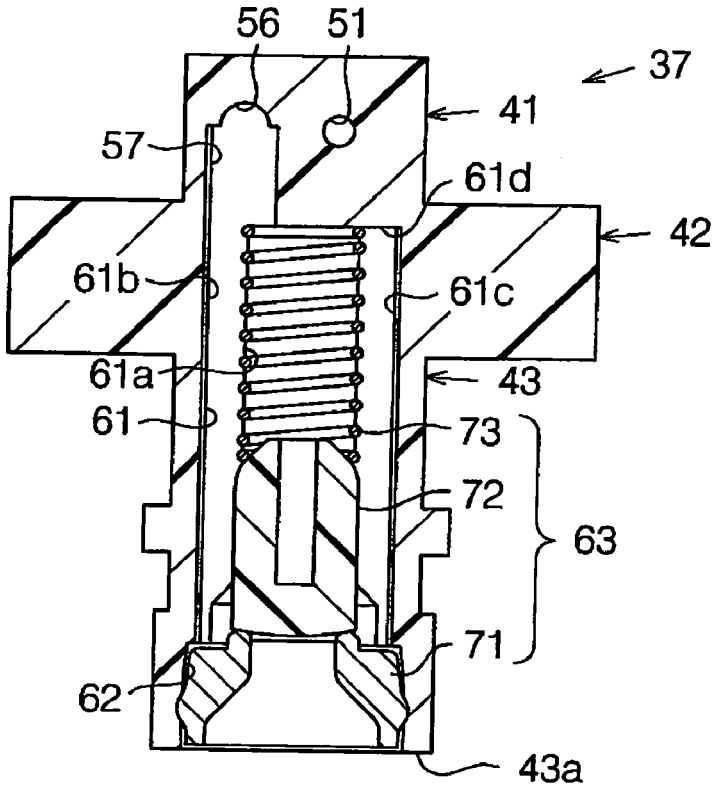
FIG. 6 is a cross-sectional view of the outlet portion according to Embodiment 1.

When the outlet portion 37 is heat-welded onto the bag portion 36, the opening of the large recess portion 45 is sealed by the laminate film 36*a*. Thus, the first recess portion 47 and the laminate film 36*a* form a valve body accommodating chamber 55. The second recess portion 48, the third recess portion 49 and the laminate film 36*a* form a third ink flow path 56. As shown in FIG. 5 and FIG. 6, a fourth ink flow path 57 extends from this third ink flow path 56 in the direction along the axis line A (see FIG. 3). The first ink flow path 46, the second ink flow path 51, the valve body accommodating chamber 55, the third ink flow path 56, and the fourth ink flow path 57 form a liquid flow path.

Moreover, a first valve body 58 as a valve body is movably accommodated in the valve body accommodating chamber 55. The first valve body 58 is capable of unattachedly migrating in the valve body accommodating chamber 55 so as to stop a flow of ink or air attempting to flow into the space S of the ink pack 25. In detail, as shown in FIG. 3, the first valve body 58 comprises a disc portion 58*a*, the diameter of which is slightly smaller than that of the inner wall surface of the first recess portion 47 and is greater than that of the valve seat 53, and a cylinder portion 58*b*, the diameter of which is smaller than the disc portion 58*a*, as regulating means. As shown in FIG. 5, the first valve body 58 is accommodated in the valve body accommodating chamber 55 such that the disc portion 58*a* can abut against the valve seat 53 and the cylinder portion 58*b* can abut against the laminate film 36*a*.

In this embodiment, this first valve body 58 and the valve seat 53 form a first valve device 59. This first valve device 58 operates so that the disc portion 58*a* is forced by fluid and moves away from the valve seat 53 when the fluid pressure in the second ink flow path 51 is higher than the fluid pressure in the valve body accommodating chamber 55, i.e., when fluid flows from the second ink flow path 51 to the valve body accommodating chamber 55. Accordingly, the second ink flow path 51 and the valve body accommodating chamber 55 are made in fluid communication with each other.

The first valve device 58 also operates so that the disc portion 58*a* is forced by fluid and abuts against the valve seat 53 when the fluid pressure in the second ink flow path 51 is lower than the fluid pressure in the valve body accommodating chamber 55, i.e., when fluid attempts to flow from the valve body accommodating chamber 55 to the second ink flow path 51. Accordingly, the second ink flow path 51 is made in fluid non-communication with the valve body accommodating chamber 55. That is, the first valve device 59 functions as a check valve, which allows the flow of fluid from the second ink flow path 51 to the valve body accommodating chamber 55, and stops the reverse flow of fluid.

The inner wall surface of the first recess portion 47 regulates the movement of the first valve body 58 in the direction perpendicular to the direction where the first valve body 58 abuts against and moves away from the valve seat 53.

As shown in FIG. 3, in this embodiment, the second flow path forming component 42 has a boat shape in a cross-sectional view of the direction perpendicular to the axis line A. That is, the second flow path forming component 42 has two side surfaces 42*a*, 42*b* which connects to each other at lateral ends (see FIG. 7), and each of which is formed by a convex surface flush with and connecting to the corresponding convex surface of the first flow path forming component 41, and two concave surfaces smoothly connecting, at one end thereof, to a respective lateral end of the convex surface of the second flow path forming component 42 and also connecting, at the other end, to the opposing concave surface of the second flow path forming component 42, to thereby present the boat shape in the cross-sectional view. In this embodiment, the third flow path forming component 43 has a circular shape in a cross-sectional view of the direction perpendicular to the axis line A.

Figure 7:
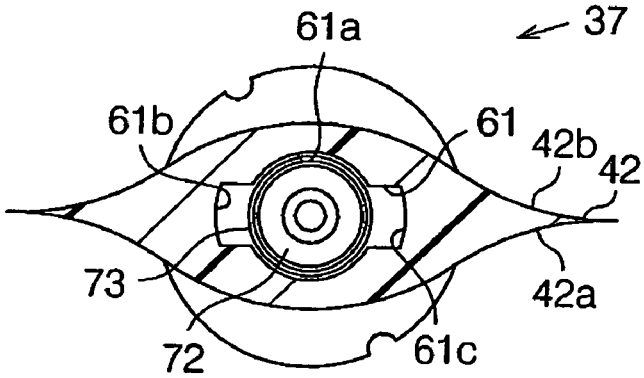
FIG. 7 is a cross-sectional view of the outlet portion according to Embodiment 1.

As shown in FIG. 6, these second and third flow path forming components 42 and 43 have a fifth ink flow path 61, and a sixth ink flow path 62 arranged in this order from the first flow path forming component 41 side along the axis line A (see FIG. 3). The fifth ink flow path 61 communicates with the fourth ink flow path 57 formed in the first flow path forming component 41. As shown in FIG. 7, the fifth ink flow path 61 is formed such that diametrically opposing two grooves 61*b* and 61*c* are formed in and recessed from a circular portion 61*a* having a cross-sectional circular shape.

As shown in FIG. 6, the sixth ink flow path 62 communicates, at one end thereof with the fifth ink flow path 61, and communicates, at the other end, with the outside through the bottom surface 43*a* of the third flow path forming component 43. In this embodiment, the sixth ink flow path 62 has a cross-sectional circular shape.

Thus, the first ink flow path 46, the second ink flow path 51, the valve body accommodating chamber 55, the third ink flow path 56, the fourth ink flow path 57, the fifth ink flow path 61, and the sixth ink flow path 62 form a series of liquid flow paths in the outlet portion 37.

In addition, a second valve device 63 is provided in these fifth and six ink flow paths 61, and 62. In detail, the second valve device 63 comprises a rubber packing 71, a second valve body 72, and a coil spring 73. In this embodiment, the rubber packing 71 has an annular shape, and is inserted concentrically into the sixth ink flow path 62.

In this embodiment, the second valve body 72 has a nearly cylindrical shape, and is located in the fifth ink flow path 61. The second valve body 72 has a size capable of slidably moving along the circular portion 61*a* of the fifth ink flow path 61. By this sliding movement, one end of the second valve body 72 can abut against and move away from the rubber packing 71. As a result, opening of the rubber packing 71 is closed or opened, and therefore fluid communication between the fifth ink flow path 61 and the sixth ink flow path 62 is interrupted or established. Additionally, the other end of the second valve body 72 has a tapered shape.

The coil spring 73 is a compression spring, and is located in the fifth ink flow path 61 between the first flow path forming component 41 side and the second valve body 72. The coil spring 73 has an outer diameter of approximately the same as the second valve body 72. One end of the coil spring 73, abuts against the bottom surface 61*d* of the fifth ink flow path 61, and the other end thereof abuts against the tapered portion of the second valve body 72.

That is, the coil spring 73 can expand and contract inside the fifth ink flow path 61, and biases the second valve body 72 in a direction in which the second valve body 72 abuts against the rubber packing 71. In addition, when an external force is not applied to the coil spring 73, the second valve body abuts against the rubber packing 71 by the biasing force 72 of the coil spring 73 to close the fifth ink flow path 61.

As shown in FIG. 2 and FIG. 5, heat welding the laminate films 36*a* and 36*b* onto the side surfaces 41*a* and 41*c* of the first flow path forming component 41, and the side surfaces 42*a* and 42*b* (see FIG. 7) of the first flow path forming component 42 fixes the outlet portion 37 mentioned above to the bag portion 36. As shown in FIG. 2, only third flow path forming component 43 is exposed outside. The first ink flow path 46 of the first flow path forming component 41 (see FIG. 3) communicates with the internal space S of the bag portion 36, and the ink contained in the internal space S of the bag portion 36 flows into the first ink flow path 46.

In addition, in the ink pack 25 as mentioned above, when the supply tube 28 (see FIG. 1) is not connected to the outlet portion 37, the second valve device 63 of the ink pack 25 is closed. Accordingly, in this state, the ink in the ink pack 25 does not flow to the outside through the outlet portion 37.

Figure 8:
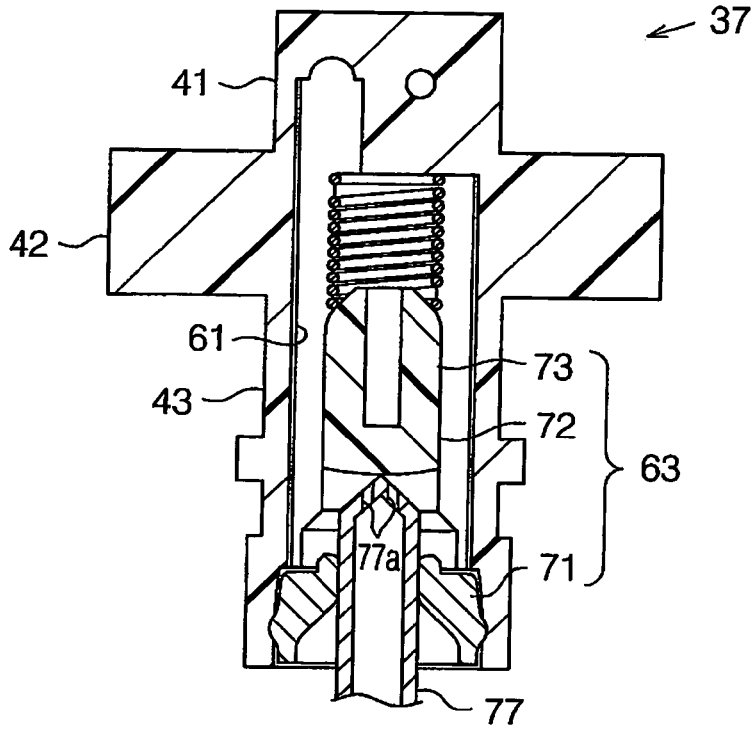
FIG. 8 is a diagram for explanation of the function of the outlet portion according to Embodiment 1.

Further, as shown in FIG. 8, when a supply needle 77 is inserted into the outlet portion 37 of the ink pack 25, the second valve body 72 is pressed by the supply needle 77, and moves toward the first flow path forming component 41. Accordingly, the second valve device 63 is opened. The supply needle 77 is a hollow needle provided at the end portion of the supply tube 28 (see FIG. 1), and a plurality of supply holes 77*a* are formed at its tip portion. Accordingly, in this state, the fifth ink flow path 61 communicates with the supply holes 77*a*of the supply needle 77.

Figure 9:
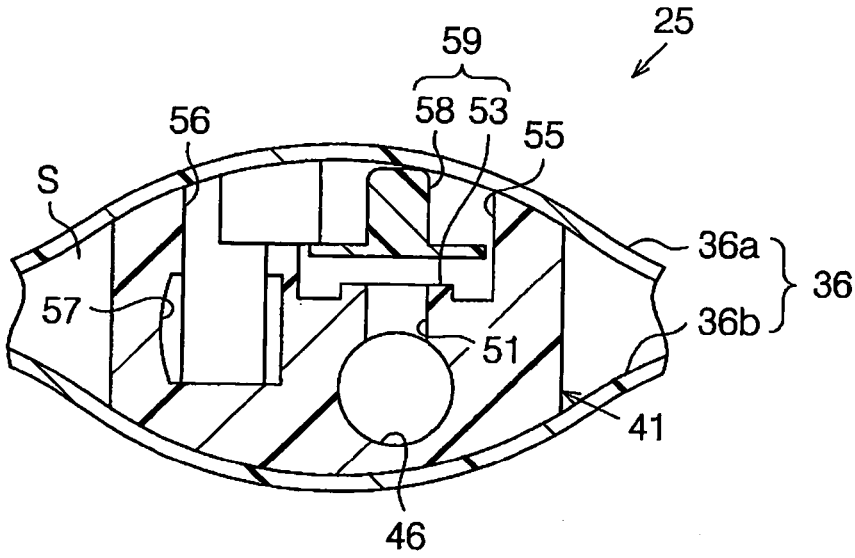
FIG. 9 is a diagram for explanation of the function of the ink pack according to Embodiment 1.

In this state, the pressure of the ink in the bag portion 36 increases when the bag portion 36 of the ink pack 25 (see FIG. 2 and FIG. 3) is pressed by drive of the pressure pump 33 (see FIG. 1). Consequently, as shown in FIG. 9, the pressure of the ink in the first ink flow path 46 and the second ink flow path 51, which flow from the bag portion 36, also increases, and the first valve body 58 is forced in the direction away from the valve seat 53 by the ink. Consequently, the first valve body 58 moves in the valve body accommodating chamber 55 to the position where its cylinder portion 58*b* abuts against the laminate film 36*a*.

As a result, the first valve device 59 becomes in the open state, as shown in FIG. 8 and FIG. 9, the internal space S of the bag portion 36 communicates with all of the first to second ink flow paths 46 and 51, the valve body accommodating chamber 55, and the third to fifth ink flow paths 56, 57 and 61. The ink contained in the internal space S of the bag portion 36 is supplied to the supply tube 28 (see FIG. 1) through the first to second ink flow paths 46 and 51, the valve body accommodating chamber 55, and the third to fifth ink flow paths 56, 57 and 61.

At this time, since the outer diameter of the supply needle 77 is designed for press-fitting with the inner diameter of the rubber packing 71, ink does not leak to the outside through the gap between the rubber packing 71 and the supply needle 77.

On the other hand, if a screw driver (not shown) or the like is forcedly inserted into the outlet portion 37 of the ink pack 25 instead of the supply needle 77, the second valve device 63 is opened. However, in such a case, since the first valve device 59 maintains a close state, it is possible to prevent leakage of the ink in the bag portion 36 to the outside.

The first valve device 59 is designed to somewhat permit the reverse flow of the fluid, but to surely establish the close state when a quick or strong reverse flow causing entry of air bubble attempt to occur. To this end, i.e. to provide a valve structure that can restrict the fluid flow in only one direction, it is preferable to set the specific gravities of the fluid and the valve body (the first valve body 58 in this embodiment) to be substantially equal to each other. In case where ink is used as the fluid, the specific gravity of the valve body (the first valve body 58 in this embodiment) is preferably set to be about $1.07\times10^{-3}$ g/mm$^3$ that is the specific gravity of ink. Here, "substantially equal" encompasses the following cases: If the first valve body has a relatively large volume (like the valve body 58 as shown in FIG. 5), the specific gravity of the fluid may be larger than that of the first valve body. This is because, in this case, a resistance is likely to occur against the movement of the valve body to assist the reverse flow preventing function. On this other hand, in a case of a film-like or plate-like valve body (as in a case of a first valve body 169 shown in FIG. 14), the specific gravity of the fluid may be smaller than that of the first valve body. This is because, if the specific gravity of the film-like or plate-like first valve body (169) is smaller than the specific gravity of the fluid, the valve body may move to and stay at an undesired position, not at an intended initial position, depending on a posture of the ink cartridge. In addition, it is preferably to restrict the movement of the first valve body 169 to such an extend as to seat on the intended initial position, and in this case the first valve body 169 may be larger in specific gravity than the fluid in order to provide the valve structure that can be closed when the quick or strong reverse flow attempts to occur.

Next, the following description will describe a component for forming a liquid container according to the present invention, taking, as an example, a component for forming an ink pack 25 mentioned above, with reference to FIG. 10 and FIG. 11. This ink pack forming component 81 becomes an ink pack 25 after processing, and components the same as or similar to those of the ink pack 25 are attached with the same reference numerals and their description is omitted.

Figure 10:
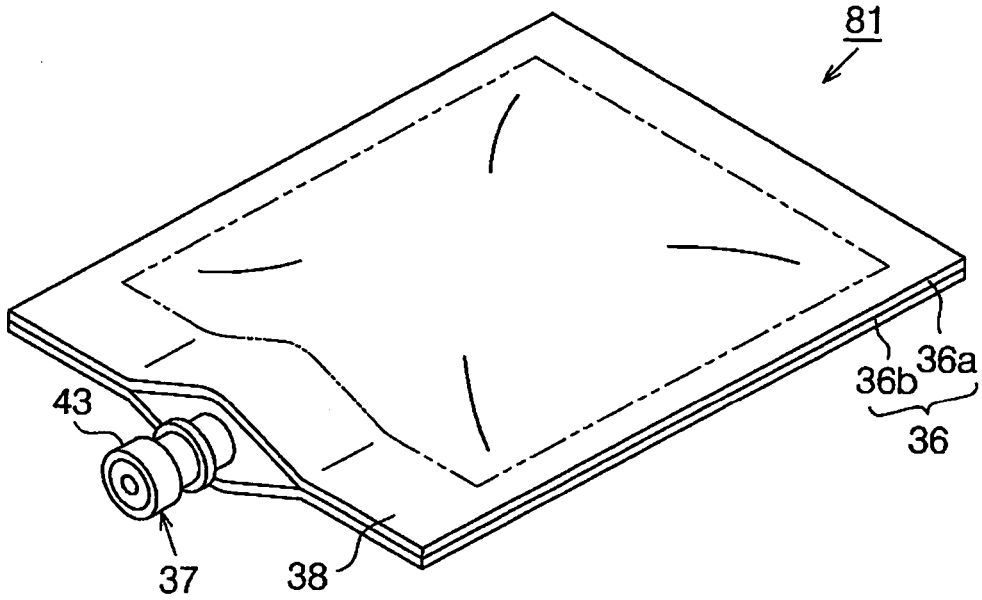
FIG. 10 is a perspective view of a component for forming an ink pack according to Embodiment 1.
Figure 11:
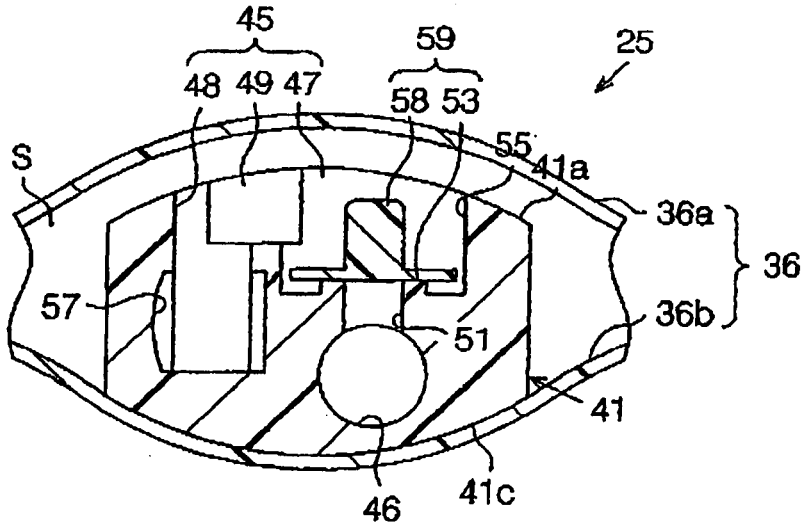
FIG. 11 is a fragmentary sectional view of the component for forming an ink pack according to Embodiment 1.

As shown in FIG. 10, the ink pack forming component 81 according to this embodiment comprises the outlet portion 37 and the bag portion 36, and ink is not contained in its internal space S (see FIG. 11). The laminate films 36*a* and 36*b* forming the bag portion 36 are heat-welded onto the side surfaces 42*a* and 42*b* (see FIG. 7) of the second flow path forming component 42 of the outlet portion 37.

As shown in FIG. 11, regarding the first flow path forming component 41 of the outlet portion 37, the laminate film 36*a* is not heat-welded onto one side surface 41*a*, but only the laminate film 36*b* is heat-welded onto another side surface 41*c*. Thus, the large recess portion 45 provided in the one side surface 41*a* of the first flow path forming component 41 of the outlet portion 37 is not sealed by the laminate film 36*a*. As a result, in this ink pack forming component 81, the formation of the valve body accommodating chamber 55, which accommodates the first valve body 58, is not complete.

In the case of the ink pack 25, if the first valve device 59 is not opened, the internal space S of the bag portion 36 cannot communicate with the valve body accommodating chamber 55 through the first and second ink flow paths 46 and 51. However, in the case of this ink pack forming component 81, the internal space S of the bag portion 36 can communicate with the large recess portion 45 without passing through the first and second ink flow paths 46 and 51.

That is, the internal space S of the bag portion 36 can communicate with the fifth ink flow path 61 of the outlet portion 37 without passing through the first valve device 59. As a result, this ink pack forming component 81 allows not only the flow of liquid from the inside of the bag portion 36 to the outside, but also the flow of liquid from the outside to the inside of the bag portion 36.

Next, the following description will describe an apparatus for injecting ink to produce the ink pack 25 using the ink pack forming component 81 mentioned above with reference to FIG. 12.

Figure 12:
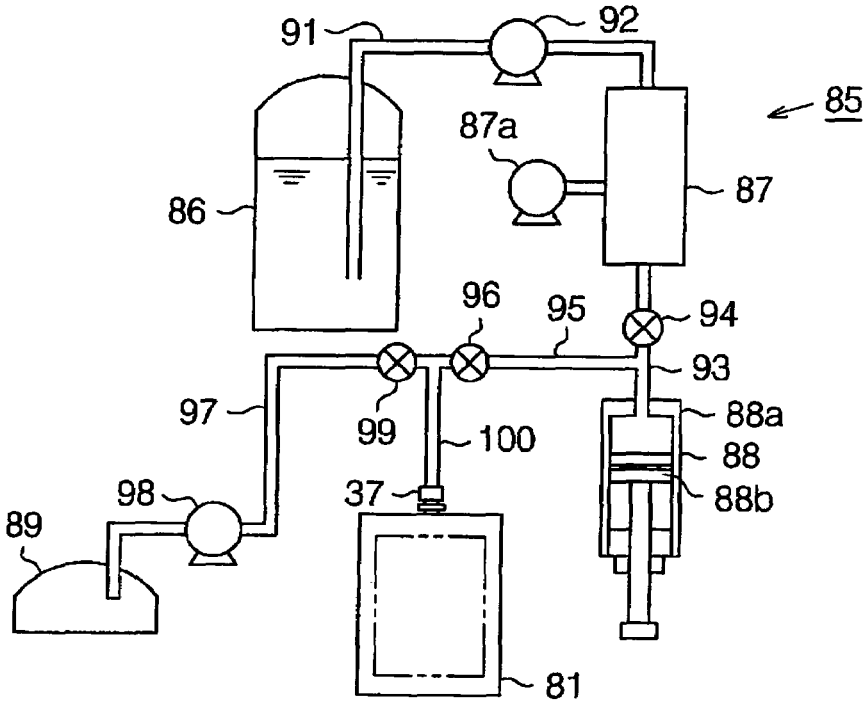
FIG. 12 is a conceptual diagram of an apparatus for injecting ink according to Embodiment 1.

As shown in FIG. 12, an ink injection apparatus 85 comprises an ink tank 86, a unit for separating gas and liquid 87, a measuring tube 88, and a waste tank 89. The ink tank 86 stores ink. The gas/liquid separating unit 87 comprises a vacuum pump 87*a*, and a bundle of hollow threads (not shown), and serves as a unit for degassing ink. The ink tank 86 and the gas/liquid separating unit 87 are connected through a first ink pipe 91. A pump for pressure-conveying ink 92 is provided midway in the first ink pipe 91.

In addition, the measuring tube 88 comprises a cylinder 88*a* and a piston 88*b*. The measuring tube 88 and the gas/liquid separating unit 87 are connected through a second ink pipe 93. A first stop valve 94 is provided midway in the second ink pipe 93. A third ink pipe 95 branches from the second ink pipe 93 at the position between the cylinder 88*a* and the first stop valve 94. A second stop valve 96 is provided midway in the third ink pipe 95.

The waste tank 89 stores unnecessary ink or the like. The waste tank 89 is connected to one end of a fourth ink pipe 97. A suction pump 98 and a third stop valve 99 are provided midway in this fourth ink pipe 97 in this order from the waste tank 89 side. Another end of this fourth ink pipe 97 is connected to the end of the third ink pipe 95. A fifth ink pipe 100 branches from the junction of the third ink pipe 95 and the fourth ink pipe 97.

A hollow needle (not shown) is provided at the end of the fifth ink pipe 100. This hollow needle is similar to the supply needle 77 (see FIG. 8) provided in the supply tube 28.

Next, the following description will describe a method for manufacturing an ink pack 25 using the ink injecting apparatus 85 mentioned above with reference to FIG. 11 and FIG. 12.

As shown in FIG. 12, first, the ink pack forming component 81 is prepared, and the hollow needle provided at the other end of the fifth ink pipe 100 is inserted into the outlet portion 37 of the ink pack forming component 81. In addition, in this embodiment, the hollow needle is inserted into the outlet portion 37, which is located at the highest position in the gravity direction in the ink pack forming component 81.

Subsequently, the method advances to a discharging process, in which the first stop valve 94 is closed, and the second and third stop valve 96 and 99 are opened, and then the suction pump 98 operates. The insides of the fourth ink flow pipe 97, the fifth ink flow pipe 100, the ink pack forming component 81, the third ink pipe 95, the second ink pipe 93, and the measuring tube 88 are decompressed successively. When the pressure in the insides becomes a predetermined value, the second and third stop valves 96 and 99 are closed, and then the first stop valve 94 is opened.

Next, the pump 92 for pressure-conveying ink operates, and the ink stored in the ink tank 86 is supplied to the gas/liquid separating unit 87, and is degassed. The degassed ink is supplied to the measuring tube 88 through the second ink pipe 93. Subsequently, the method advances to a process for injecting a small amount of liquid, in which the first stop valve 94 is closed, and the second stop valve 96 is opened, and then a very small amount of ink is discharged from the measuring tube 88 by depressing the piston 88*b* of the measuring tube 88 by a predetermined amount.

The very small amount of ink thus discharged is supplied to the inside of the ink pack forming component 81 through the second to fourth ink pipes 93, 95, and 100. At this time, since the ink pack forming component 81 is constructed as shown in FIG. 11, the ink, which flows into the fifth ink flow path 61, is directly supplied to the internal space S of the bag portion. 36 through the opening of the large recess portion 45. The valve device 59 of the ink pack forming component 81 does not operate as a check valve.

As shown in FIG. 12, subsequently after the very small amount of ink is supplied into the ink pack forming component 81, the method advances to a process for discharging a small amount of liquid, in which after the second stop valve 96 is closed, and the third stop valve 99 is opened, and then the suction pump 98 operates. Thus, the ink in the ink pack forming component 81 is conveyed to the waste tank 89 through the fifth ink pipe 100 and the fourth ink pipe 97. At this time, dust, air, and so on slightly remaining in the ink pack forming component 81 are also conveyed with the ink, therefore, it is possible to improve degassed rate and cleanliness of the ink pack forming component 81.

Subsequently, the method advances to an injecting process, in which the third stop valve 99 is closed, and the second stop valve 96 is opened, and then all ink in the cylinder 88*a* is conveyed to the ink pack forming component 81 by pressing the piston 88*b* of the measuring tube 88. Then, the hollow needle is removed from the outlet portion 37 of the ink pack forming component 81.

Subsequently, the method advances to a sealingly closing process, in which the laminate film 36*a* is heat-welded onto one side surface 41*a* (see FIG. 11) of the first flow path forming component 41 of the ink pack forming component 81 by a heat and pressure attaching tool (not shown). As a result, the ink pack 25 shown in FIG. 2 to FIG. 9 is completed. In this ink pack 25, the large recess portion 45 of the first flow path forming component 41 and the laminate film 36*a* form a valve body accommodating chamber 55. The outlet portion 37 of the ink pack 25 allows only the discharge of ink from the inside of the bag portion 36 to the outside, and stops the reverse flow of ink.

According to the above Embodiment 1, the following effects can be obtained.

(1) In the above Embodiment 1, the first recess portion 47 formed in a recessed shape in the first flow path forming component 41 of the outlet portion 37 and the laminate film 36*a*, which sealingly closes it, form the valve body accommodating chamber 55, which accommodates the first valve body 58 of the first valve device 59 provided in the ink pack 25. As a result, the valve body accommodating chamber 55 is formed of a rigid body and a flexible member joined together, and therefore the junction is improved. Accordingly, the airtightness is improved. In addition, for example, when the valve body accommodating chamber 55 is formed of rigid bodies by crimping or the like, the airtightness may be reduced by a gap, etc., caused by unevenness in dimension, however, such a deterioration can be prevented in this embodiment. As a result, it is possible to reliably isolate the valve body accommodating chamber 55 from the internal space S of the ink pack 25, so that the performance of a check valve can be constant.

(2) In the above Embodiment 1, when the ink pack 25 is produced, ink is injected into the internal space S through the first recess portion 47 in a state where the first recess portion 47 of the ink pack forming component 81 is not sealingly closed by the laminate film 36*a*. After ink injection is completed, the first recess portion 47 is sealingly closed by the laminate film 36*a* to form the valve body accommodating chamber 55. Accordingly, the ink pack 25 formed by the ink pack forming component 81 can have the first valve device 59 that allows the flow of liquid only from the internal space S of the ink pack 25 to the outside.

Therefore, even in a case where the first valve device 59 is provided in the ink pack 25 as a completed product, ink can be injected into the internal space S through the outlet portion 37 of the ink pack 25 in a state where the first recess portion 47 in the ink pack forming component 81 is not sealingly closed by the laminate film 36*a*. As a result, to manufacture the ink pack 25, the internal space S of the ink pack forming component 81 can be decompressed through the outlet portion 37, and then ink can be injected into the internal space S through the outlet portion 37 again. Accordingly, it is possible to provide the ink pack 25 containing ink with high purity. Therefore, it is not necessary to provide a large-scale decompressor to decompress the whole periphery of the ink pack forming component 81 to manufacture or produce the ink pack 25 containing ink with high purity. Accordingly, it is possible to produce the ink pack 25 at low cost.

(3) In the above Embodiment 1, the valve body accommodating chamber 55 is formed by heat-welding the first flow pass forming component 41 and laminate film 36*a*. Accordingly, it is possible to improve airtightness of the valve body accommodating chamber 55 from the internal space S, and to maintain the performance of the first valve device 59 constant.

(4) In the above Embodiment 1, the laminate film 36*a*, which forms the bag portion 36, is used to form the valve body accommodating chamber 55. Thus, the laminate film 36*a* is used commonly to a component for forming the bag portion 36 and a component for forming the valve body accommodating chamber 55. Accordingly, it is possible to reduce the number of components for the ink pack 25. As a result, it is possible to reduce the manufacturing cost of the ink pack 25.

(5) In the above Embodiment 1, the first valve body comprises a cylinder portion 58*b* for regulating the amount of the movement in the direction away from the valve seat 53. Thus, the first valve body stably moves, therefore, the first valve device 59 stably opens and closes. As a result, the performance of the first valve device 59 can be made preferable.

(6) In the above Embodiment 1, the valve seat 53 is formed so as to project toward the first valve body 58 side. According to this construction, the first valve body 58 and the valve seat 53 are in more intimate contact with each other, so that the performance of the first valve device 59 can be made preferable.

(7) In the above Embodiment 1, the first recess portion 47 is formed in a recessed shape in the first flow path forming component 41 in the direction perpendicular to the axis line A, in other words, perpendicular to the flow direction of the first ink flow path 46 and the fourth ink flow path 57. Accordingly, the first recess portion 47 is formed in a recessed shape from the one side surface 41*a* of the first flow path forming component 41, therefore, the first valve body 58 is easily accommodated in the first recess portion 58. As a result, it is possible to easily produce the ink pack 25.

Embodiment 2

Figure 13:
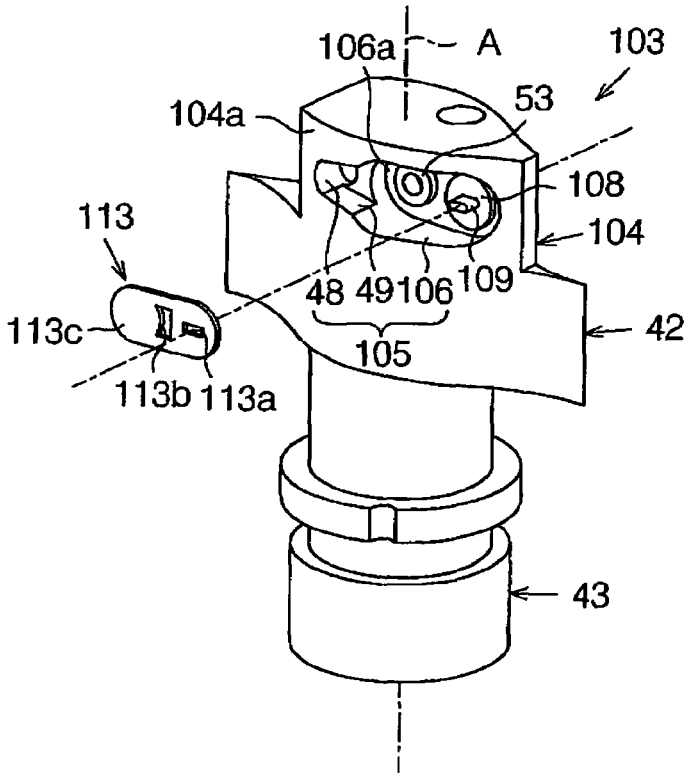
FIG. 13 is an exploded perspective view of a primary part of an outlet portion according to Embodiment 2.
Figure 14:
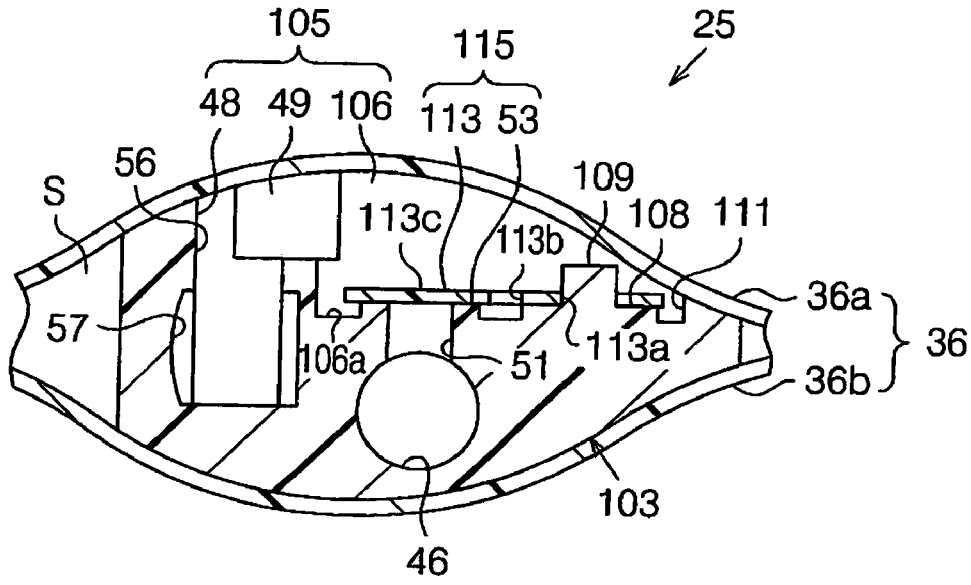
FIG. 14 is a fragmentary sectional view of the ink pack according to Embodiment 2.
Figure 15:
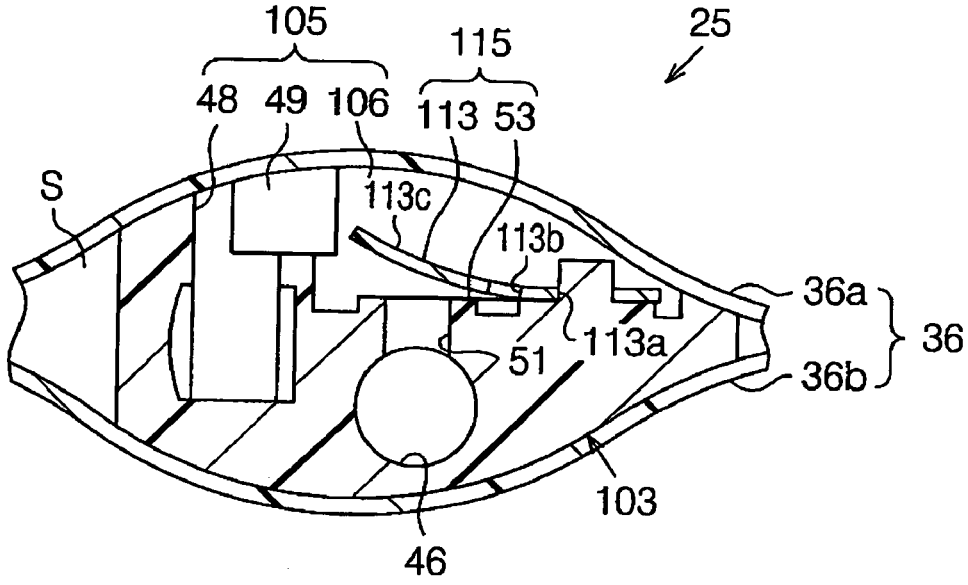
FIG. 15 is a diagram for explanation of the function of the ink pack according to Embodiment 2.

The following description will describe an Embodiment 2 to give a concrete form to the invention with reference to FIG. 13 to FIG. 15. In addition, in Embodiment 2, only a construction corresponding to the outlet portion 37 of the ink pack 25 according to Embodiment 1 is different from Embodiment 1, therefore, description of components the same as or similar to those of Embodiment 1 is omitted.

As shown in FIG. 13, an outlet portion 103 according to this embodiment comprises a first flow path forming component 104, a second flow path forming component 42, and a third flow path forming component 43. Regarding the second and third flow path forming components 42 and 43, their constructions are similar to those of Embodiment 1, and description is omitted.

The first flow path forming component 104 has a large recess portion 105 which is recessed from one side surface 104*a* in the direction perpendicular to the axis line A. The large recess portion 105 includes a first recess portion 106 having a cross-sectional ellipse shape as a recess portion for accommodating a valve body, a second recess portion 48, and a third recess portion 49. As shown in FIG. 14, a first projecting portion 108 is formed at the right side of the valve seat 53 on the bottom surface 106*a* of the first recess portion 106, and a second projecting portion 109 is formed on this first projecting portion 108. As shown in FIG. 13, the first projecting portion 108 is formed in a cylinder shape, and its height from the bottom surface 106*a* is the same as the valve seat 53. In addition, the second projecting portion 109 is formed in a cross-sectional ellipse shape.

As shown in FIG. 14, when the outlet portion 103 is heat-welded onto the bag portion 36, the opening of the large recess portion 105 is sealed by a laminate film 36*a*. Thus, the first recess portion 106 and the laminate film 36*a* form a valve body accommodating chamber 111. In this first flow path forming component 104, the first ink flow path 46, the second ink flow path 51, the valve body accommodating chamber 111, the third ink flow path 56, and the fourth ink flow path 57 form a series of a liquid flow path.

Moreover, a deformable first valve body 113 as a valve body is accommodated in the valve body accommodating chamber 111. In detail, as shown in FIG. 13, the first valve body 113 is formed of the elastic material to have a plate-like shape elliptic in a plane view. The first valve body 113 has a fit hole 113*a* having a nearly rectangular shape, being located at its right side and passing through the first valve body 113. This fit hole 113*a* has such a size that the second projecting portion 109 formed in the first recess portion 106 can be fitted into the fit hole 113*a*. A through hole 113*b* is formed in the center part of the first valve body 113. By forming this through hole 113*b*, the first valve 113 is provided with a circular portion 113*c* having a circular shape at the left side. This circular portion 113*c* has a diameter greater than that of the valve seat 53.

As shown in FIG. 14, the first valve body 113 as mentioned above is accommodated in the valve body accommodating chamber 111, and the second projecting portion 109 is fitted into the fit hole 113*a*, so that the first valve body 113 is fixed and supported in a cantilevered manner. When an external force is not applied to the first valve body 113, its circular portion 113*c* abuts the valve seat 53 by its elastic force (elasticity) Thus, the first valve body 113 interrupts communication between the second ink flow path 51 and the valve body accommodating chamber 111.

In this embodiment, this first valve body 113 and the valve seat 53 form a first valve device 115. As shown in FIG. 15, this first valve body 113 operates so that the circular portion 113*c* is forced by the fluid when the fluid pressure in the second ink flow path 51 is higher than the fluid pressure in the valve body accommodating chamber 111, i.e., when fluid flows from the second ink flow path 51 to the valve body accommodating chamber 111. As a result, since the through hole 113*b* is formed in the center part of the first valve body 113 to make the center part more flexible, the first valve body 113 bends at the center part. Thus, the circular portion 113*c* of the first valve body 113 moves upward, and moves away from the valve seat 53. As a result, the second ink flow path 51 communicates with the valve body accommodating chamber 111.

On the other hand, the first valve body 113 operates so that the circular portion 113*c* is forced by fluid and kept in abutment against the valve seat 53 when the fluid pressure in the second ink flow path 51 is smaller than the fluid pressure in the valve body accommodating chamber 111, i.e., when fluid attempts to flow from the valve body accommodating chamber 111 to the second ink flow path 51. Accordingly, the second ink flow path 51 is made in a non-communicating state with the valve body accommodating chamber 111. That is, the first valve device 115 functions as a check valve, which allows the flow of liquid from the second ink flow path 51 to the valve body accommodating chamber 111, and stops the reverse flow of fluid.

According to the above Embodiment 2, the following effects can be obtained in addition to the effects (1)-(4), (6), and (7) of Embodiment 1.

(8) In the above Embodiment 2, the first valve body 113 is formed of an elastic material, and the second projecting portion 109 formed in the first flow path forming component 104 is fittingly inserted into the fit hole 113*a* formed at its one end so that the first valve body 113 is supported in a cantilevered manner. The first valve body 113 is normally in contact with the valve seat 53 by its own elastic force, when an external force is not applied thereto. Accordingly, it is possible to control the opening-and-closing of the first valve device 115 more easily.

Embodiment 3

Figure 16:
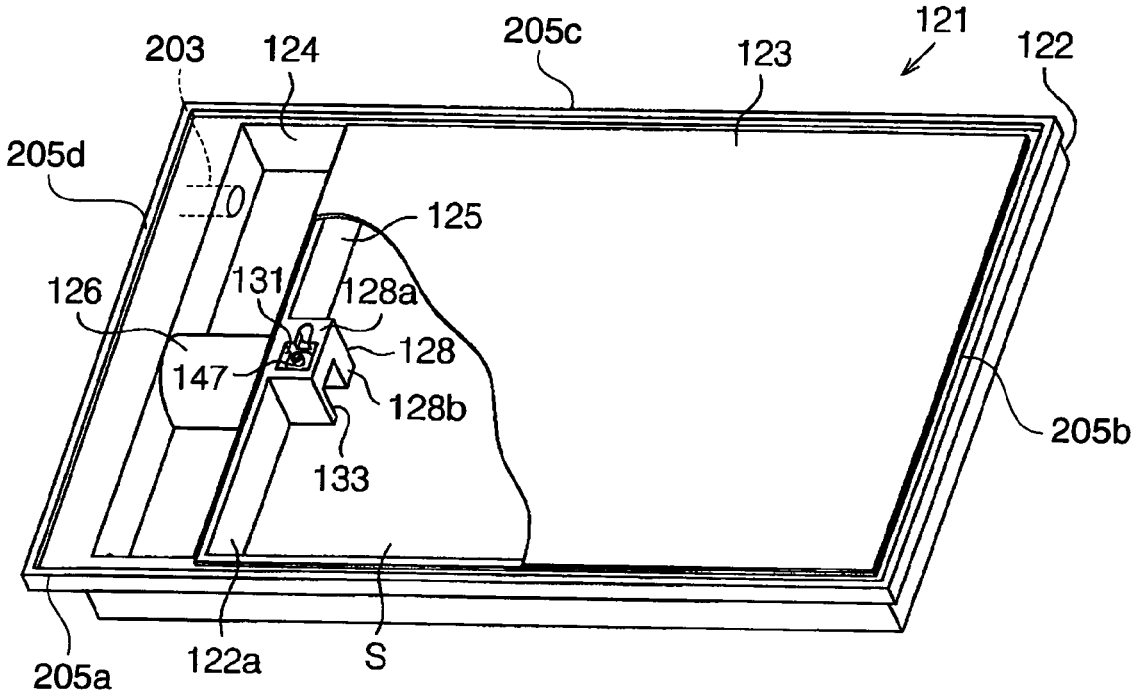
FIG. 16 is a cutaway perspective view of a primary part of an ink pack according to Embodiment 3.
Figure 17:
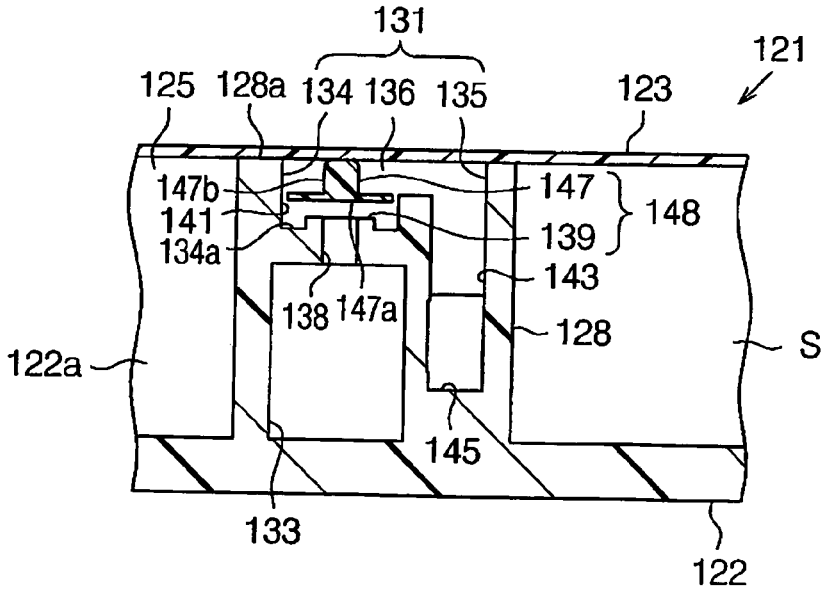
FIG. 17 is a fragmentary sectional view of the ink pack according to Embodiment 3.

The following description will describe an Embodiment 3 to give a concrete form to the invention with reference to FIG. 16 and FIG. 17. In addition, in Embodiment 3, only a construction corresponding to the ink pack 25 according to Embodiment 1 is different from Embodiment 1, therefore, description of components the same as or similar to those of Embodiment 1 is omitted.

As shown in FIG. 16, an ink pack 121 as a liquid container according to this embodiment comprises a box body 122 with an opening in the topside as a component for forming liquid containing portion, and a film member 123, which sealingly closes the opening in the top side of the box body 122, as a third flexible member. The inside of the box body 122 is divided into two areas by a dividing board 122*a*. Accordingly, the box body 122 has a first space 124, and a second space 125 that serves as a recess portion for containing liquid.

The first space 124 is formed with a cylinder body 126 extending across the first space 124 in the central part of the first space 124. An ink path (not shown) corresponding to the fifth ink path 61 and the sixth ink path 62 of the above Embodiment 1 is provided inside the cylinder body 126. This ink path is provided for communication between the outside of the box body 122 and the second space 125 of the box body 122. Further, a valve device (not shown) corresponding to the second valve device 63 of the above Embodiment 1 is provided inside the cylinder body 126. Accordingly, inserting the supply needle 77 of Embodiment 1 (see FIG. 8) into this cylinder body 126 opens the valve device provided inside the cylinder body 126, so that the supply tube 28 (see FIG. 1) communicates with the second space 125.

In addition, a first flow path forming component 128 is provided in the second space, and is adjacent to the cylinder body 126 of the first space 124. In this embodiment, the cylinder body 126 and the first flow path forming component 128 form a flow path forming component. This first flow path forming component 128 corresponds to the first flow path forming component 41 of Embodiment 1, and is formed with the box body 122 integrally in this embodiment. Moreover, the height of the first flow path forming component 128 is approximately the same as the height of each side of the box body 122.

As shown in FIG. 16 and FIG. 17, a large recess portion 131 is recessed from the top plane 128*a* of the first flow path forming component 128. A first ink flow path 133 is recessed from the side plane 128*b* (see FIG. 16) of the first flow path forming component 128 in a direction parallel to the cylinder body 126. This first ink flow path 133 communicates with the internal space of the second space 125.

The large recess portion 131 comprises a first recess portion 134 having a cross-sectional square shape, which serves as a recess portion for accommodating a valve body. The large recess portion 131 further comprises a second recess portion. 135 having a cross-sectional circular shape, and a third recess portion 136 communicating the first recess portion 134 with the second recess portion 135. A second flow path 138 extends from the bottom surface 134*a* of the first recess portion 134. This second ink flow path 138 communicates with the first ink flow path 133. An annular valve seat 139 is formed in and projected from the bottom surface 134*a* of the first recess portion 134 so as to surround the outlet of the second ink flow path 138.

The film member 123 is formed in a size capable of sealingly closing the whole top plane 128*a* of the first flow path forming component 128 and the whole opening of the second space 125 together. In this embodiment, a portion, which covers the top plane 128*a* of the first flow path forming component 128, of the film member 123 corresponds to a first flexible member, and a remaining portion, i.e. a portion, which covers the opening of the second space 125, corresponds to a second flexible component. The film member 123 is heat-welded onto the top plane 128*a* of the first flow path forming component 128 and the opening of the second space 125.

As shown in FIG. 17, the top plane 128*a* of the first flow path forming component 128 is sealingly closed by the film member 123, and the recess portion 134 and the film member 123 form the valve body accommodating chamber 141. The second and third recess portions 135 and 136 and the film member 123 form a third ink flow path 143. A fourth ink flow path 145, which communicates with the ink flow path formed in the cylinder body 126, is formed in the first flow path forming component 128. This third ink flow path 143 communicates with this fourth ink flow path 145.

Thus, the first ink flow path 133, the second ink flow path 138, the valve body accommodating chamber 141, the third ink flow path 143, and the fourth ink flow path 145 form a series of a flow path.

Moreover, a first valve body 147 as a valve body is movably accommodated in the valve body accommodating chamber 141. The first valve body 147 is capable of unattachedly migrating in the valve body accommodating chamber 141 so as to stop a flow of ink or air attempting to flow into the internal space S of the space 125. This first valve body 147 is similar to the first valve body 58 of Embodiment 1. In this embodiment, this first valve body 147 and the valve seat 139 form a first valve device 148. That is, the first valve body 147 functions as a check valve, which allows the flow of fluid from the second ink flow path 138 to the valve body accommodating chamber 141, and stops the reverse flow of fluid.

As shown in FIG. 16 and FIG. 17, the internal space S is formed by sealingly closing the second space 125 by the film member 123. That is, in this embodiment, a liquid containing portion is formed of the second space 125 and the film member 123. The internal space S communicates with the first ink flow path 133 formed in the first flow path forming component 128. The internal space S contains ink, and the first ink flow path 133 is also filled with ink flowing therein.

When the supply tube 28 is not connected to the cylinder body 126 of the ink pack 121 as mentioned above, the valve device in the cylinder body 126 is closed. Accordingly, in this state, the ink in the ink pack 121 does not flow to the outside through the first flow path forming component 128 and the cylinder body 126.

When the supply needle 77 is inserted into the cylinder body 126 of the ink pack 121, the valve device in the cylinder body 126 is opened, and the ink flow path formed in the cylinder body 126 communicates with the supply needle. In this state, the pressure of the ink contained in the internal space S increases when the film member 123 of the ink pack 121 is pressed by air supplied through a pressurized air inlet port 203 by drive of the pressure pump 33 (see FIG. 1). Thus, the first valve device 148 is opened, and the internal space S communicates with the supply tube. As a result, the ink filled in the internal space S is supplied to the supply tube 28. In addition, in order to apply pressure to the ink pack 121, a hermetically sealing film (not shown) is heat-welded onto outer peripheral rib or flange portions 205*a*, 205*b*, 205*c* and 205*d* to define an airtight space between the film 123 and the hermetically sealing film. The pressurized air supplied through the pressurized air inlet port 203 is introduced through the space 124 into the airtight space between the film 123 and the hermetically sealing film, to thereby press, through the film 123, the ink contained in the internal space S. An additional upper lid member may be fixed to the box body 122 to be overlaid on the hermetically sealing film.

Next, the following description will describe an ink pack forming component for forming the ink pack 121 as mentioned above. This ink pack forming component becomes the ink pack 121 by processing, and its description will be described with reference to FIG. 16 and FIG. 17. In addition, components the same as or similar to those of the ink pack 121 are attached with the same reference numerals and their description is omitted.

The ink pack forming component according to this embodiment is a component which corresponds to the ink pack 121 shown in FIG. 16 and FIG. 17, but the internal space S of which is not filled with ink. Although, in the ink pack 121, the film member 123 is heat-welded onto the top surface 128*a* of the first flow path forming component 128, in this ink pack forming component, the film member 123 is not heat-welded onto the top surface 128*a* of the first flow path forming component 128. As a result, in case of this ink pack forming component, the valve body accommodating chamber 141 is not formed yet, thus, the first recess portion 134 communicates with the internal space S.

That is, the internal space S can communicate with the ink flow path formed in the cylinder body 126 without passing through the first valve device 148. As a result, this ink pack forming component allows not only the flow of liquid from the internal space S to the outside, but also the flow of liquid from the outside to the internal space S.

Accordingly, in this embodiment, it is also possible to produce or manufacture the ink pack 121 with this ink pack forming component by the processes similar to Embodiment 1.

According to the above Embodiment 3, the following effects can be obtained in addition to the effects (1)-(3), (5)-(7) of Embodiment 1.

(9) In the above Embodiment 3, the height of the first flow path forming component 128 is approximately same as the height of the second space 125, thus, the film member 123 can seal both the second space 125 and the large recess portion 131 of the first flow path forming component 128 together. Accordingly, one film member 123 can seal the second space 125 to form the internal space S, and the large recess portion 131 to form the valve body accommodating chamber 141 at the same time. As a result, this can save effort in producing the ink pack 121, and can reduce manufacturing cost.

In addition, the above Embodiments 1 through 3 maybe modified as described below.

In the above Embodiment 1 and 2, the laminate film 36*a*, which forms the valve body accommodating chamber 55, 111, is a common component for forming the bag portion 36. This may be a component separated from a component for forming the bag portion 36.

Figure 18:
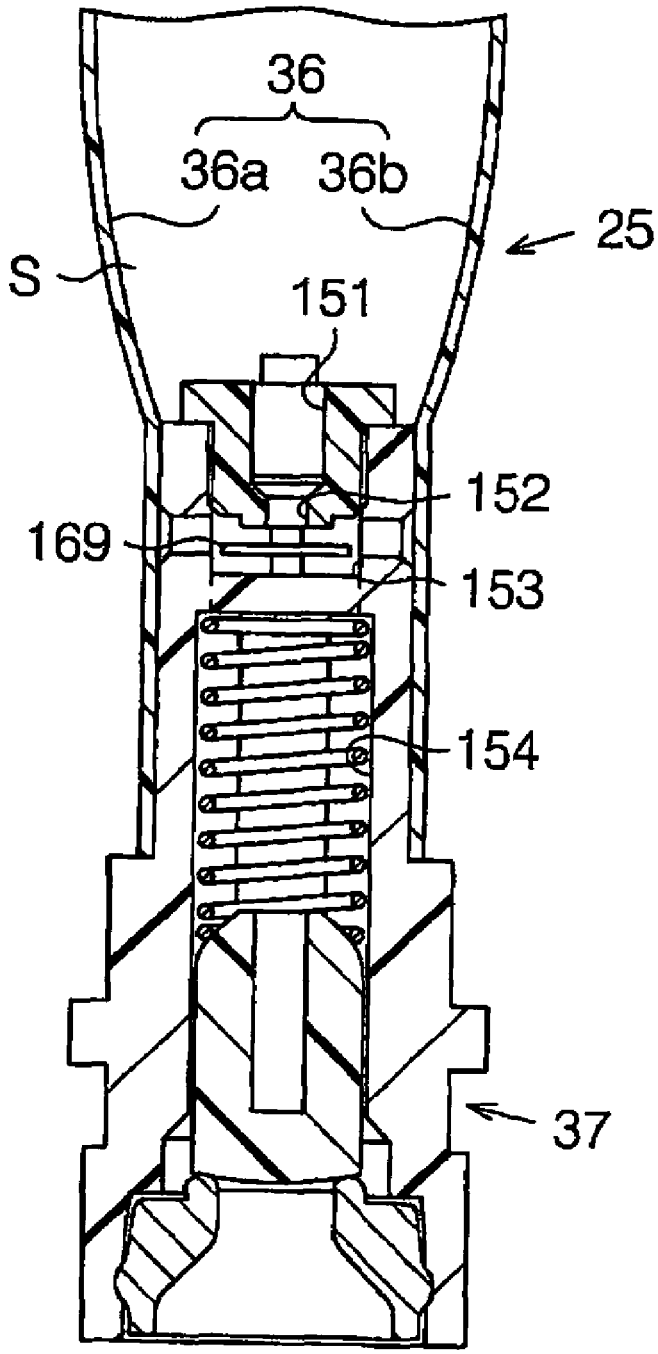
FIG. 18 is a fragmentary sectional view of the ink pack according to another embodiment.

In the above Embodiments 1 through 3, the liquid flow paths formed in the ink pack 25, 121 such as the first ink flow path 46, 133, the second ink flow path 51, 138, the valve body accommodating chamber 55, 111, 141, the third ink flow path 56, the fourth ink flow path 57, and the fifth ink flow path 61, etc., are not aligned in a straight line. As shown in FIG. 18, this construction may be modified such that a first ink flow path 151, a second ink flow path 152, a valve body accommodating chamber 153, the fifth ink flow path 154, etc., are aligned in a straight line.

Figure 19:
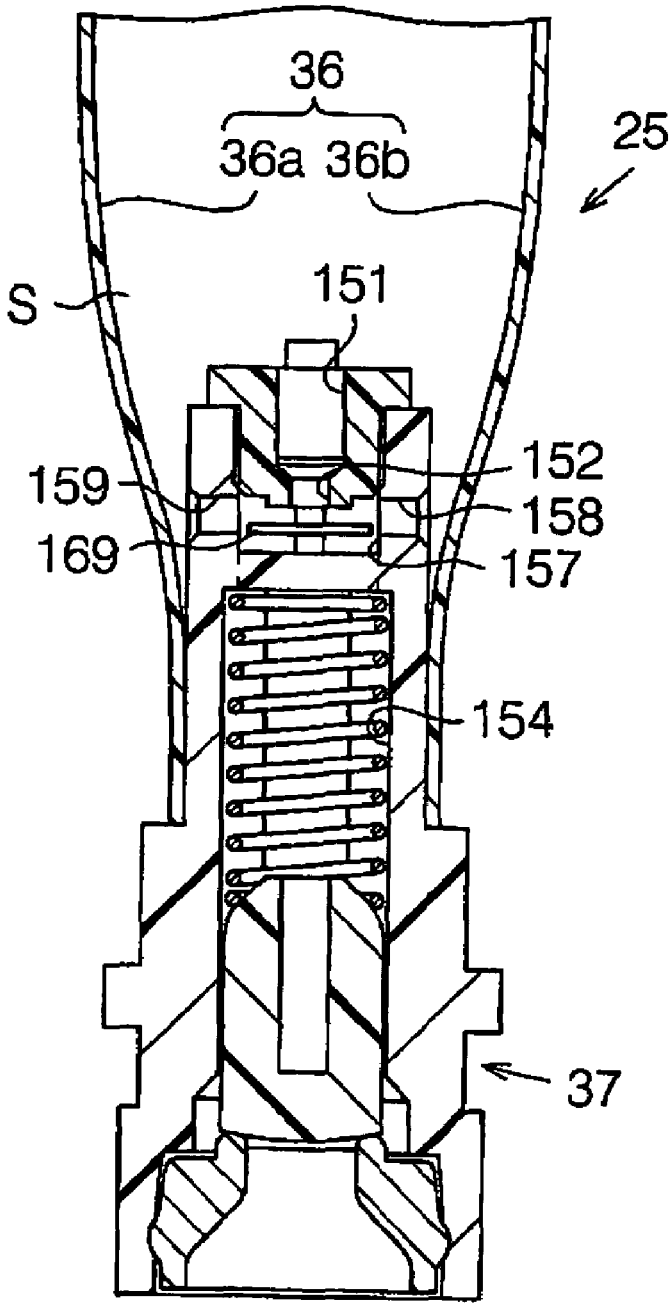
FIG. 19 is a fragmentary sectional view of a component for forming an ink pack according to another embodiment.

In such a case, as shown in FIG. 19, the valve body accommodating chamber 153 may be formed by sealingly closing the accommodating chamber 157 as a recess portion for accommodating a valve body with laminate films 36*a* and 36*b* so as to be in non-communication with the internal space S without passing through the first valve device. This accommodating chamber 157 may be formed with two communication holes 158 and 159 communicating with the internal space S and opposing each other, and these communication holes 158 and 159 may be sealingly closed with the laminate films 36*b* and 36*a*, respectively, so that the valve body accommodating chamber 153 is in non-communication with the internal space S without passing through the first valve device.

Figure 20:
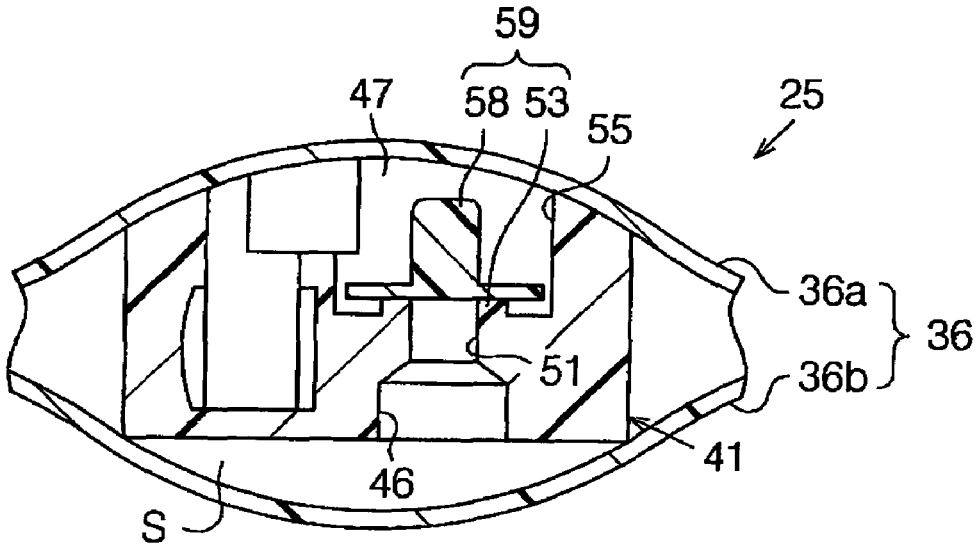
FIG. 20 is a fragmentary sectional view of the ink pack according to another embodiment.

In the above Embodiments 1 through 3, the first ink flow path 46, 133 is formed so as to extend in the direction perpendicular to the direction in which the first recess portion 47, 106, 134 forming the valve body accommodating chamber 55, 111, 141 is recessed. As shown in FIG. 20, this construction may be modified such that the first ink flow path 46 is formed in a direction coincident with the direction in which the first recess portion 47 is recessed, whereby the first recess portion 47, the second ink flow path 51, and the first ink flow path 46 are aligned in a straight line. In this modification, one through hole can be formed in the first flow path forming portion 41 to define all of the first recess portion 47, the second ink flow path 51, and the first ink flow path 46 at the same time. Therefore, it is possible to produce the ink pack 25 easily.

In the above Embodiment 1, the first recess portion 47 formed in the first flow path forming portion 41 has a cross-sectional circular shape having a diameter slightly larger than a diameter of the disc portion 58*a* of the first valve body 58. As long as the first valve body 58 is movable in the first recess portion 47, and a gap is formed so that ink flows between the first recess portion 47 and the first valve body 58, the shapes of the first recess portion 47 and the first valve body 58 may be modified, respectively.

Figure 21:
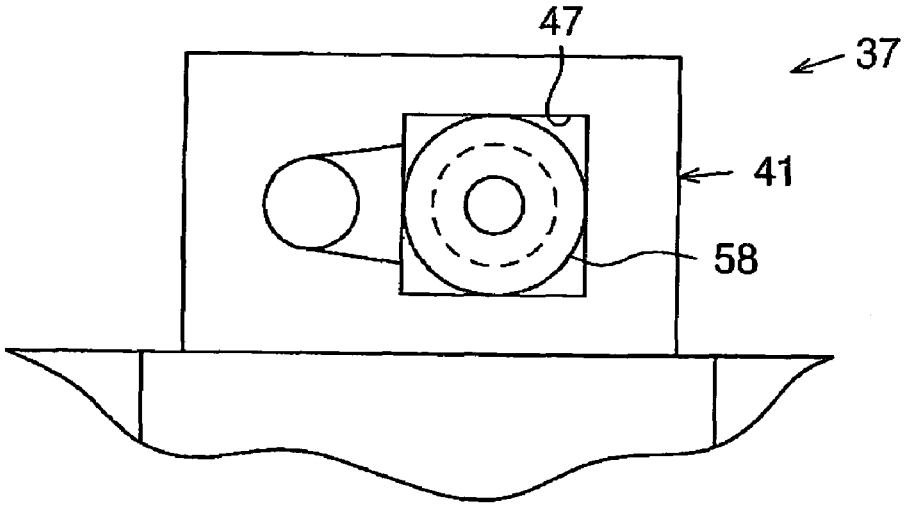
FIG. 21 is a plan view of a primary part of an outlet portion according to another embodiment.
Figure 22:
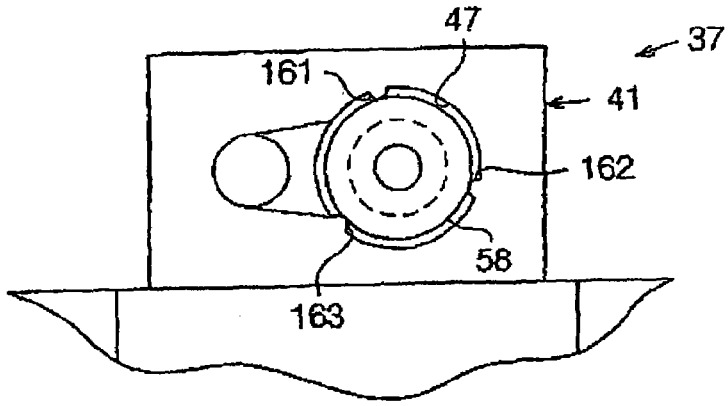
FIG. 22 is a plan view of a primary part of an outlet portion according to another embodiment.

For example, as shown in FIG. 21, the first recess portion 47 may be formed in a cross-sectional rectangular shape. Further, as shown in FIG. 22, protruding ribs 161, 162 and 163, which are in contact with the first valve body 58, may be provided on the inner circumference surface of the first recess portion 47. In this case, the movement of the first valve body 58 can be more accurate.

Figure 23:
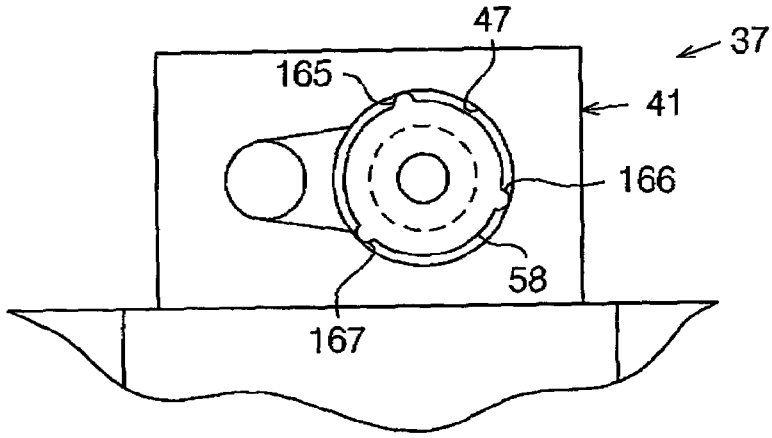
FIG. 23 is a plan view of a primary part of an outlet portion according to another embodiment.

Moreover, as shown in FIG. 23, projections 165, 166, and 167, which contact the first recess portion 47, may be provided on the outer surface of the first valve body 58. Also, in this case, the movement of the first valve body 58 can be more accurate.

Figure 24:
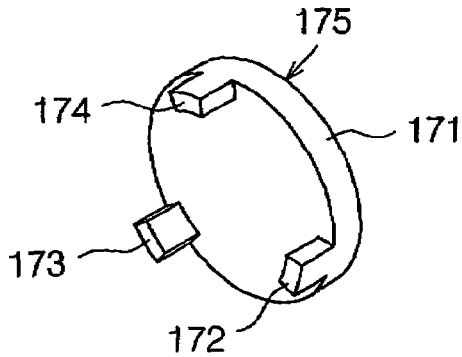
FIG. 24 is a perspective view of a first valve body according to another embodiment.
Figure 25:
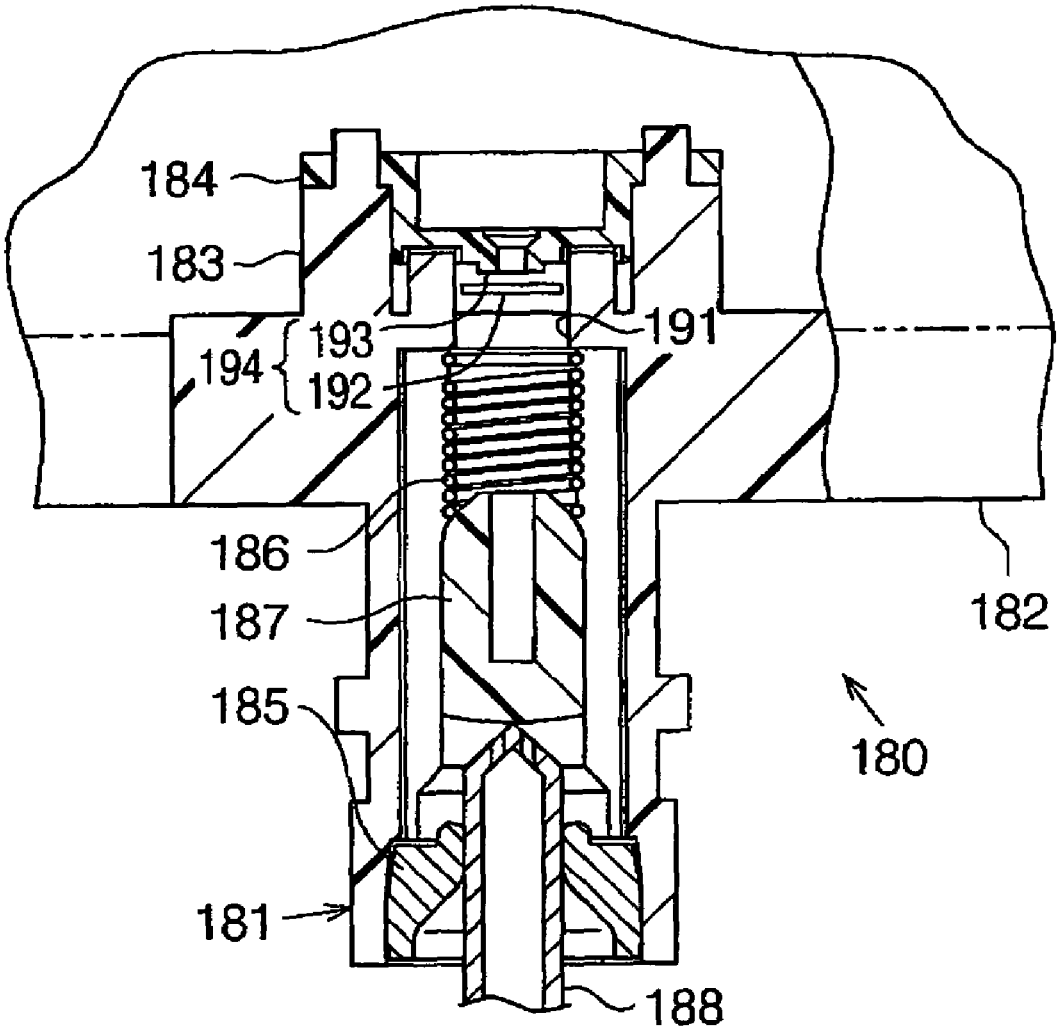
FIG. 25 is a fragmentary sectional view of a conventional ink pack.

In the above Embodiments 1 and 3, the first valve body 58, 147 comprises the disc portion 58*a*, 147*a*, and the cylinder portion 58*b*, 147*b* as regulating means. The first valve body 58, 147 may be dispensed with the regulating means. For example, the disc shape first valve body 169 as shown in FIG. 18 and FIG. 19 may be used in the Embodiments 1 and 3. As shown in FIG. 24, the first valve body may be formed of a disc portion 171, and projections 172, 173, and 174 projecting from the edge of the disc portion 171 as regulation means.

In the above Embodiments 1 through 3, the valve seat 53,139 is formed so as to project toward the first valve body 58, 113, 147, however, the valve seat 53, 139 may be formed without projecting.

In the above Embodiments 1 through 3, the sealingly closing process is conducted such that the one side surface 41*a* of the first flow path forming component 41 is heat-welded to the laminate film 36*a*, or the top plane 128*a* of first flow path forming component 128 is heat-welded to the film member 123, however, they may be sealingly closed with any other means. For example, they may be sealingly closed with an adhesive agent.

In the above Embodiments 1 and 2, a method for manufacturing the ink pack 25 comprises the discharging process, the process for injecting a small amount of liquid, and the process for discharging a small amount of liquid in addition to the injecting process and the sealingly closing process. The method may only comprise the injecting process, and the sealingly closing process. In addition, the method may only additionally comprise the discharging process in addition to the injecting process, and the sealingly closing process. Additionally, the method may only additionally comprise the process for injecting a small amount of liquid, and the process for discharging a small amount of liquid in addition to the injecting process and the sealingly closing process.

In the above Embodiment 3, the ink pack 121 is manufactured by the processes similar to Embodiment 1. This manufacturing method may be modified such that the injecting process is performed after the sealingly closing process. That is, before the injecting process, the method may conduct the sealingly closing process, in which the first flow path forming component 128 and the second space 125 of the ink pack forming component are sealingly closed by the film member 123. In this case, an opening may be provided in a part of the second space 125 so that the film member 123 does not sealingly close this opening, and the injecting process may be conducted such that ink is injected into the internal space S of the ink pack forming component via this opening. The opening may be closed after the injection of ink. Even in this modification, the injecting process can be conducted so that ink is injected into the internal space S without passing through the first valve device 148.

Figure 26:
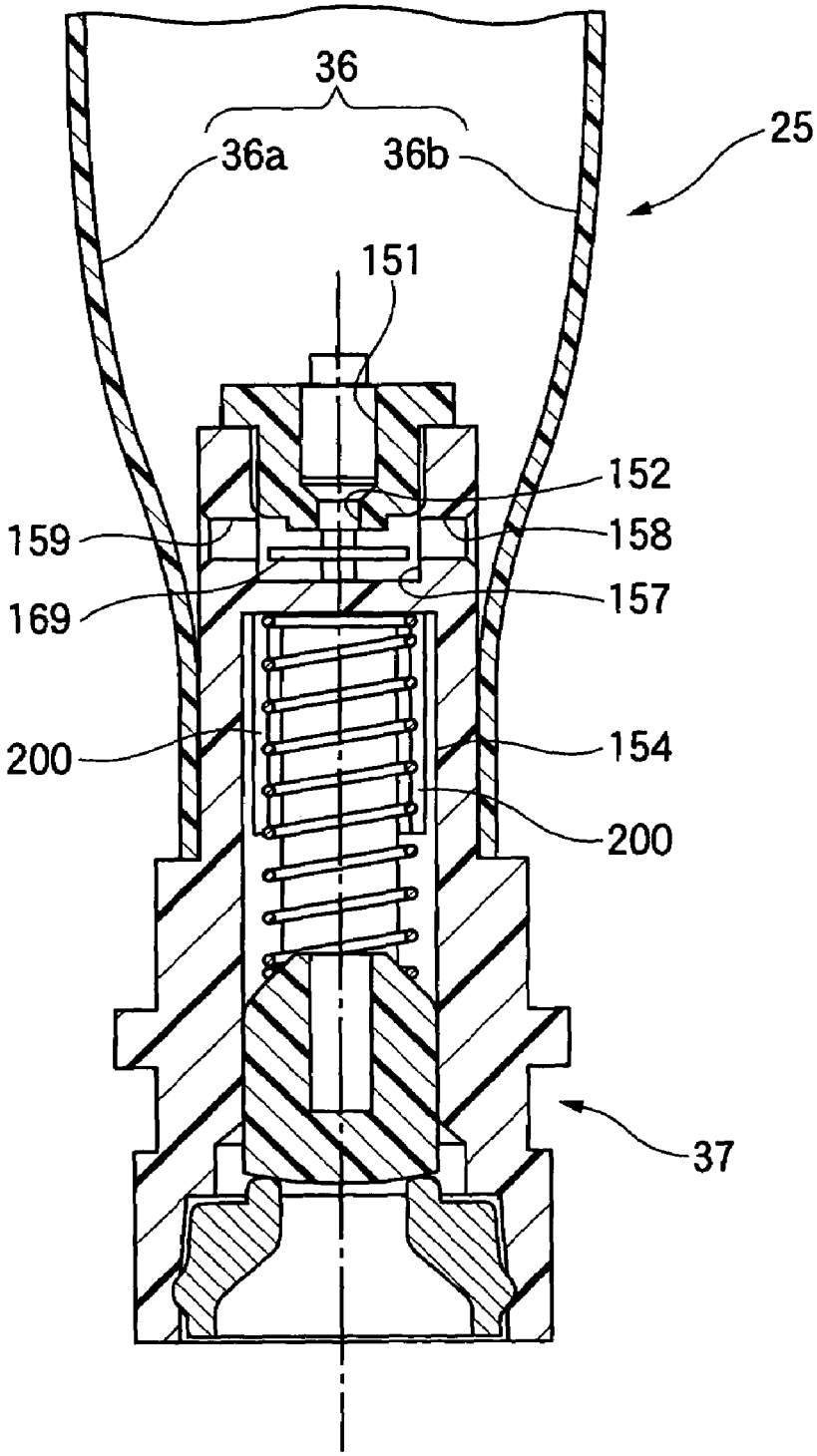
FIG. 26 is a sectional view of an ink outlet portion having a rib as means for preventing deformation.
Figure 27:
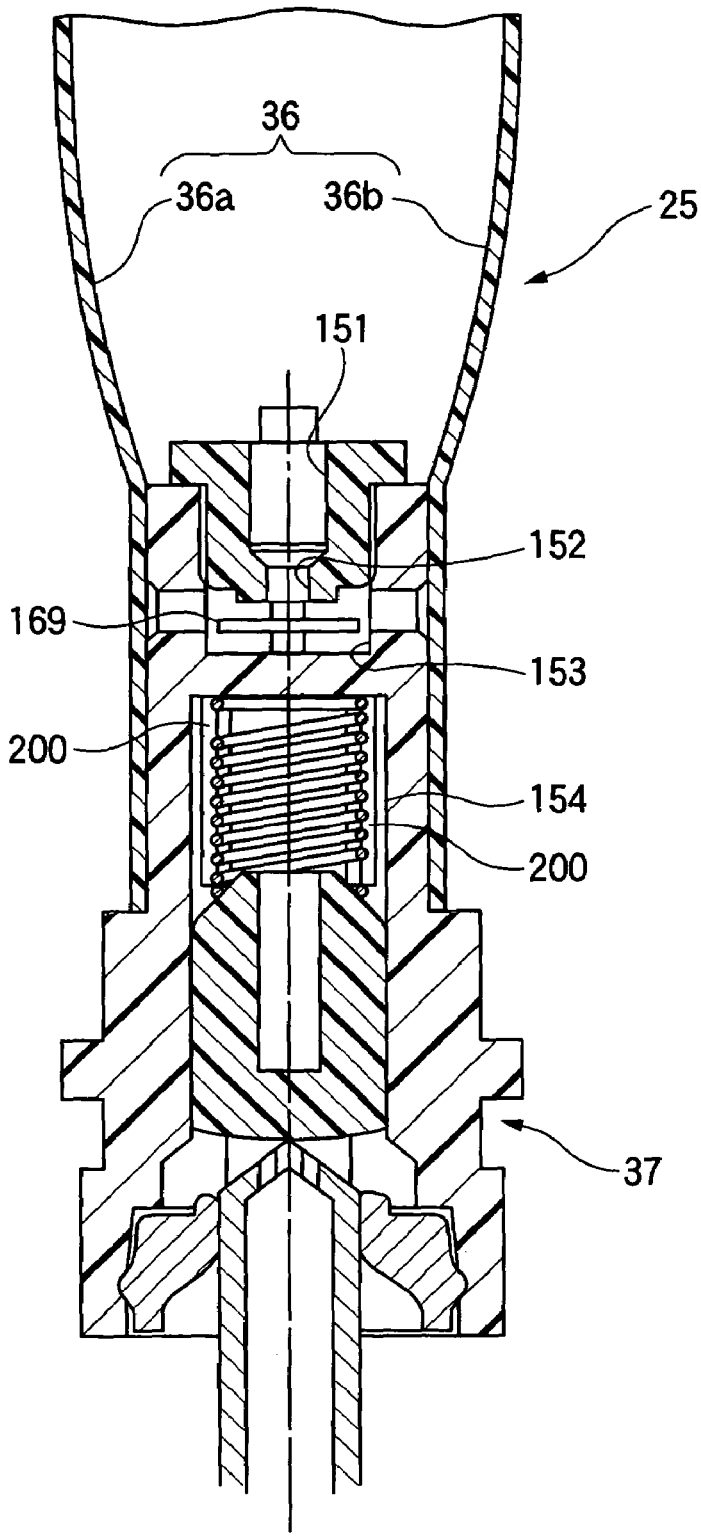
FIG. 27 is a sectional view of an ink outlet portion having the same.

In addition, in the above embodiments, as shown in FIGS. 26 and 27, in order to prevent deformation of the liquid flow path in the sealingly closing process, in which the laminate film is welded onto the flow path forming component, a rib or ribs 200 may be provided in the circular portion of the fifth ink flow path as means for preventing deformation.

Accordingly, since the means for preventing deformation prevents deformation of the ink flow path, it is possible to ensure operation of the second valve body and to smoothly discharge the ink in the internal space S to the outside through the ink flow path even when a part of the second valve device is provided in the ink flow path located on the welded portion.

Additionally, since the means for preventing deformation is a rib or ribs, the welded portion, which is the outer periphery of the ink flow path, is partly thicker. Thus, the ink flow path hardly deforms as increasing the thickness of the welded portion. Further, since a portion with increased thickness is limited to only a part of it, it is possible to keep appearance of a sink to a minimum. Therefore, the liquid flowpath forming component and the laminate film can be easily made in intimate contact with each other.

Figure 28:
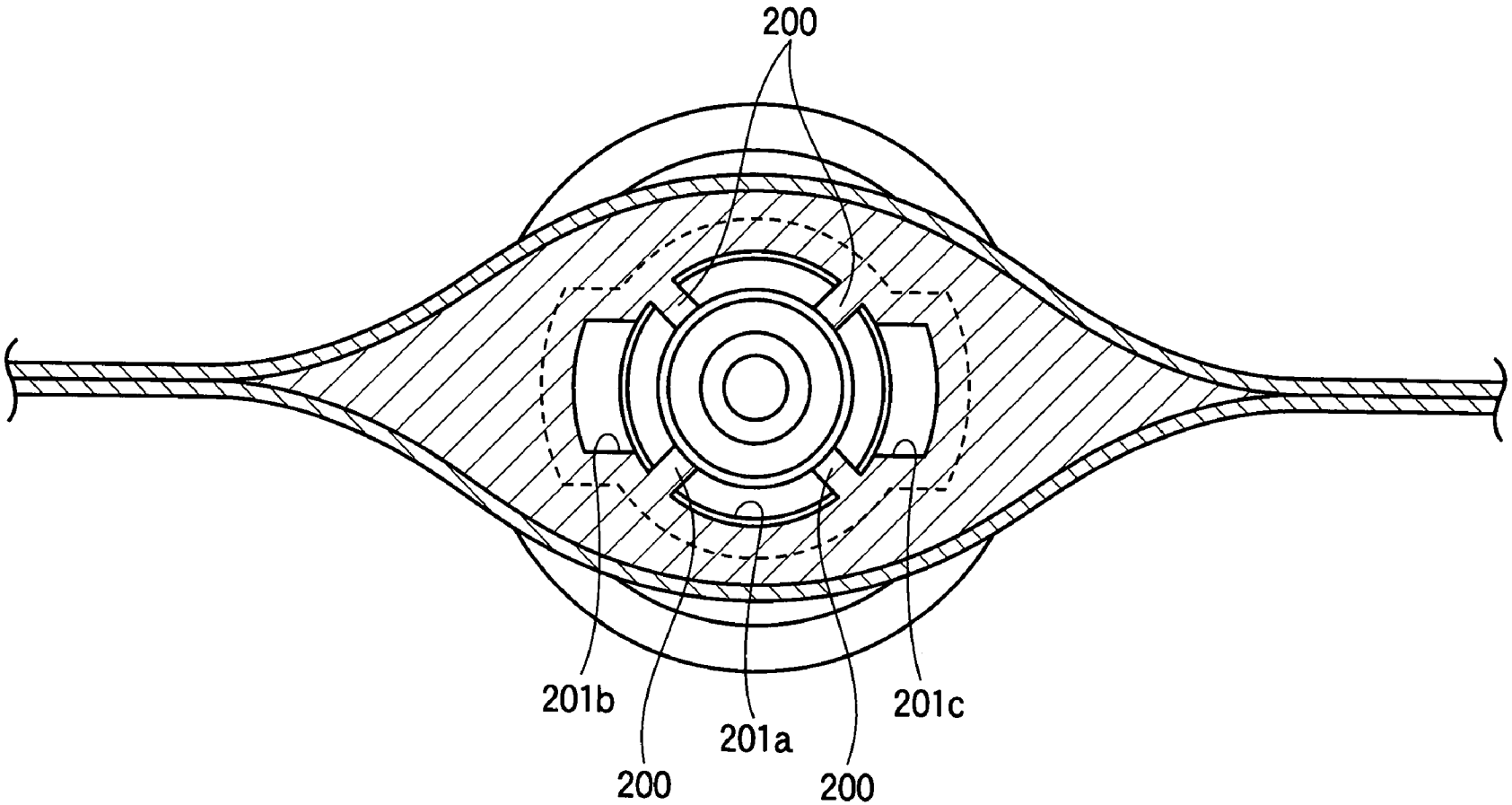
FIG. 28 is a sectional view of an ink outlet portion having the same.

Further, as shown in FIG. 28, a plurality of ribs 200 are formed in and projected from the circular portion 201*a* on the fifth ink flow path so as to be located between two opposing grooves 201*b* and 201*c*. Further, as shown in FIG. 27, each of the ribs extends in length and location corresponding to the welded portion of the fifth ink flow path. Accordingly, as shown in FIG. 27, the second valve body abuts against and regulated by these ribs 200, so that the valve body does not move to the position corresponding to the welded portion. That is, since the ribs 200 function as regulating means, the second valve body, which opens and closes, does not come into the ink flow path corresponding to the welded portion, which may deform. Therefore, it is possible to ensure that the ink flow path is opened and closed more reliably.

As a result, it is possible to reduce the number of components and to provide these means at low cost.

The shape of each rib 200 and arrangement of the ribs are not limited to those shown in FIG. 28. Any suitable shape and arrangement can be adopted for the ribs 200 as long as the thickness of the periphery around the circular portion 201 of the ink flow path can be partially made thicker by the ribs 200.

The regulating means, which regulates the valve body to prevent the valve body from moving into the position corresponding to the welded portion, may be realized without the use of the ribs mentioned above. That is, the welded portion is set in one end side of the fifth ink flow path as shown in FIG. 26, and the regulating means may be realized as long as the regulating means has such a function as to prevent the second valve body from moving into the position corresponding to the welded portion. Even if a fluid flow path corresponding in location to the welded portion is accidentally deformed by welding, the presence of such regulating means can prevent. the second valve body from moving into the deformed fluid flow path corresponding to the welded portion and can ensure the opening and closing operation of the second valve body. Accordingly, it is possible to avoid a possibility that the second valve body moves into and is caught by the deformed fluid flow path and does not perform the intended operation. Therefore, the opening and closing operation of the valve device can be reliably performed.

Figure 29:
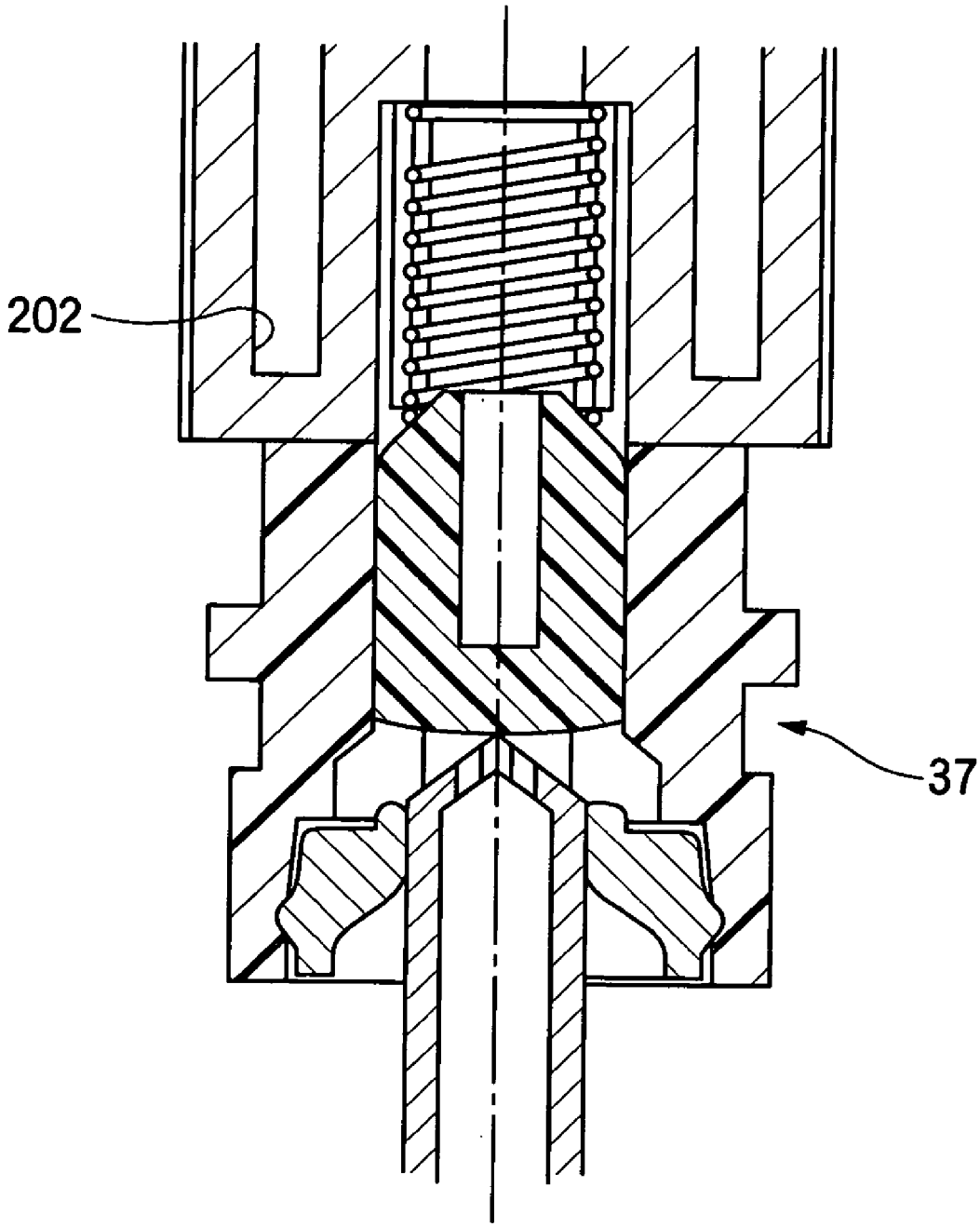
FIG. 29 is a sectional view of an ink outlet portion with a plurality of deformation preventing rooms around the periphery of liquid flow path as a means for preventing deformation.

In addition, as shown in FIG. 29, a plurality of deformation preventing spaces 202 may be provided around the outer periphery of the liquid flow path as means for preventing deformation.

Accordingly, since the total thickness (total radial thickness) from the outer periphery of the welded portion to the liquid flow path can be thick, it is possible to keep deformation of the liquid flow path to a minimum. Further, since the thickness of the continuous portion can be thin, it is possible to keep the appearance of a sink to a minimum, and to allow for the liquid flow path forming component and the film member to be in intimate contact with each other easily.

In place of the deformation preventing spaces 202, a plurality of holes (for example, blind holes extending in a direction parallel to an axis of liquid flow path) may be provided around the liquid flow path. Further, two or more deformation preventing spaces 202 may be provided around the liquid flow path. That is, for example, two or more deformation preventing spaces 202 may be provided radially between the liquid flow path and the outer periphery of the welded portion. Further, in place of the annular or arcuate deformation preventing spaces 202, a spiral space groove may be provided around the liquid flow path. That is, it is sufficient to provide, in the outer periphery of the circular portion 201*a*, such a space as to be deformed prior to the deformation of the circuit portion 201*a* due to heat during heat-welding.

In place of the deformation preventing means, such a modification may be adopted, in which the movement of the second valve body is not guided by the circular portion of the liquid flow path, and one end portion of the coil spring, which is a part of the valve device, is provided in the circular portion of the liquid flow path. In this case, a large clearance is provided between the inner wall of the circular portion corresponding in location to the welded portion and the one end portion of the coil spring, the valve device can be more reliably operated even if the liquid flow path corresponding in location to the welded portion is deformed due to heat during the heat-welding.

Although Embodiments 1 to 3 have been discussed with reference to a case in which the liquid container (and the liquid container forming component) supplies ink as liquid via the flexible supply tube 28 to the recording head 20 mounted on the carriage 15, the present invention is applicable to a case in which the liquid container (and the liquid container forming component) is directly mounted on the carriage.

Although Embodiments 1 to 3 have been discussed with reference to a case in which the ink pack is pressurized to supply ink therefrom, the present invention is applicable to a case in which, the ink pack is not pressurized, and ink is supplied from the ink pack by a negative pressure caused, for example by ejection of ink from the recording head.

In the above Embodiments 1 through 3, the ink packs 25 and 121, and the ink pack forming component 81, which are provided for a printer 11 (including a printing apparatus such as a facsimile and a copier), are described as a liquid container and a liquid container forming component. The present invention may be embodied as a liquid container and a liquid container forming component, which are used for the other liquid ejecting apparatus ejecting the other liquid. For example, the liquid ejecting apparatus, to which the present invention is applicable, includes, not limited to, 1) a liquid ejecting apparatus, which ejects liquid such as an electrode material, a color material, or the like, used for producing a liquid crystal display, an EL display, plane light-emitting display, etc., 2) a liquid ejecting apparatus for ejecting a biogenic organic material used for producing a biochip, and 3) a test material ejecting apparatus as a high-precision pipette. Moreover, liquid other than ink may be used as the liquid.

What is claimed is:

1. A liquid container comprising:

a liquid containing portion containing liquid, the liquid containing portion being formed at least in part from a first flexible component;

a flow path forming component connected to the liquid containing portion, the flow path forming component having a valve body accommodating recess portion formed therein;

a liquid flow path, provided in the flow path forming component, for communication between an inside of the liquid containing portion and an outside; and a check valve, provided in the liquid flow path, for limiting flow of liquid between the inside of the liquid containing portion and the outside to only a single direction, wherein the check valve includes a valve seat and a valve body, the valve body is accommodated in a valve body accommodating chamber formed in the liquid flow path and defined by the valve body accommodating recess portion, the valve body accommodating recess portion is sealingly closed by the first flexible component, the liquid flow path is defined by the first flexible component and the valve body accommodating recess portion sealingly closed by the first flexible component, and the liquid flow path includes at least a part of the first flexible component.

2. The liquid container according to claim 1, wherein the check valve allows the flow of liquid from the inside of the liquid containing portion to the outside and stops the flow of liquid from the outside to the inside of the liquid containing portion, the valve body is located between the outside and the valve seat, the valve body accommodating recess portion communicates with the inside of the liquid containing portion in a state where the valve body accommodating recess portion is not sealingly closed by the first flexible component, and does not communicate with the inside of the liquid containing portion in a state where the valve body accommodating recess portion is sealingly closed by the first flexible component.

3. The liquid container according to claim 1, wherein the first flexible component sealingly closes the valve body accommodating recess portion by being heat-welded onto the flow path forming component.

4. The liquid container according to claim 1, wherein the valve body includes means for regulating an amount of movement of the valve body in a direction away from the valve seat.

5. The liquid container according to claim 1, wherein the valve seat is projected toward the valve body.

6. The liquid container according to claim 1, wherein a direction in which the valve body accommodating recess portion is recessed from a surface of the flow path forming component is perpendicular to a flow direction of a part of the liquid flow path.

7. The liquid container according to claim 1, wherein the liquid flow path includes a first liquid flow path that is located between the valve body accommodating chamber and the inside of the liquid containing portion, and that extends on and along an extension of a direction in which the valve body accommodating recess portion is recessed from a surface of the flow path forming component.

8. The liquid container according to claim 1, wherein the liquid is ink, the liquid container is an ink pack used for an ink jet recording apparatus.

9. The liquid container according to claim 1, wherein the valve body is different from the first flexible component.

10. The liquid container according to claim 1, wherein the first flexible component is secured to the flow path forming component so as to sealingly close the valve body accommodating recess portion.

11. A liquid container forming component, comprising:

a liquid containing portion capable of containing liquid;

a flow path forming component connected to the liquid containing portion;

a liquid flow path, provided in the flow path forming component, for communication between an inside of the liquid containing portion and an outside;

a check valve, provided in the liquid flow path, for allowing only flow of liquid from the inside of the liquid containing portion to the outside;

a valve body accommodating recess portion formed in the flow path forming component so that the liquid flow path communicates with the inside of the liquid containing portion through the valve body accommodating recess portion; and a first flexible component capable of sealingly closing the valve body accommodating recess portion and integrally formed with the liquid containing portion, the first flexible component being adapted to interrupt direct communication between the valve body accommodating recess portion and the inside of the liquid containing portion when the first flexible component sealingly closes the valve body accommodating recess portion, wherein the check valve includes a valve seat and a valve body located between the outside and the valve seat, the valve body is located inside the valve body accommodating recess portion, the liquid flow path is defined by the first flexible component and the valve body accommodating recess portion sealingly closed by the first flexible component, and the liquid flow path includes at least a part of the first flexible component.

12. A method for producing a liquid container, comprising the steps of providing a liquid container forming component comprising: a liquid containing portion capable of containing liquid; a flow path forming component connected to the liquid containing portion; a liquid flow path, provided in the flow path forming component, for communication between an inside of the liquid containing portion and an outside; a check valve, provided in the liquid flow path, for allowing only flow of liquid from the inside of the liquid containing portion to the outside; and a valve body accommodating recess portion formed in the flow path forming component so that the liquid flow path communicates with the inside of the liquid containing portion through the valve body accommodating recess portion and a valve body of the check valve is accommodated in the valve body accommodating portion;

injecting the liquid into the inside of the liquid containing portion through the valve body accommodating recess portion; and sealingly closing the valve body accommodating recess portion by a flexible component that is integrally formed with the liquid containing portion so as to interrupt direct communication between the valve body accommodating recess portion and the inside of the liquid containing portion, wherein the liquid flow path is defined by the flexible component and the valve body accommodating recess portion sealingly closed by the flexible component, and the liquid flow path includes at least a part of the flexible component.

13. A method for producing a liquid container, comprising the steps of:

providing a liquid container forming component comprising: a liquid containing portion capable of containing liquid; a flow path forming component connected to the liquid containing portion; a liquid flow path, provided in the flow path forming component, for communication between an inside of the liquid containing portion and an outside; a check valve, provided in the liquid flow path, for allowing only flow of liquid from the inside of the liquid containing portion to the outside, and a valve body accommodating recess portion formed in the flow path forming component so that the valve body accommodating recess portion communicates with the liquid flow path and a valve body of the check valve is accommodated in the valve body accommodating portion, wherein the liquid containing portion includes a liquid containing portion forming component that is integral with the flow path forming component, and that has a liquid containing recess portion;

sealingly closing the valve body accommodating recess portion by a flexible component, and the liquid containing recess portion by the flexible component; and injecting the liquid into a space formed by the liquid containing recess portion and the flexible component, wherein the liquid flow path is defined by the flexible component and the valve body accommodating recess portion sealingly closed by the flexible component, and the liquid flow path includes at least a part of the flexible component.

* * * * *